US008821018B2

(12) United States Patent
Tan

(10) Patent No.: US 8,821,018 B2
(45) Date of Patent: Sep. 2, 2014

(54) BAGS WITH REINFORCED BAG WALLS

(71) Applicant: Daniel Brian Tan, Harahan, LA (US)

(72) Inventor: Daniel Brian Tan, Harahan, LA (US)

( * ) Notice: Subject to any disclaimer, the term of this patent is extended or adjusted under 35 U.S.C. 154(b) by 163 days.

(21) Appl. No.: 13/689,580

(22) Filed: Nov. 29, 2012

(65) Prior Publication Data

US 2014/0147059 A1 May 29, 2014

(51) Int. Cl.

| | |
|---|---|
| ***B65D 33/10*** | (2006.01) |
| ***B65D 33/02*** | (2006.01) |
| ***B65D 30/08*** | (2006.01) |
| ***B65D 33/06*** | (2006.01) |

(52) U.S. Cl.

CPC ..... *B65D 33/02* (2013.01); *B65D 29/02* (2013.01); *B65D 33/065* (2013.01)

USPC ..... 383/8; 428/35.7; 383/9; 383/105; 383/119; 383/120; 383/107; 383/121

(58) Field of Classification Search

CPC ..... B65D 33/02; B65D 33/065; B65D 29/02

USPC ..... 428/35.7; 383/8, 9, 105.119, 120, 107, 383/121

See application file for complete search history.

(56) References Cited

U.S. PATENT DOCUMENTS

| | | | | |
|---|---|---|---|---|
| 3,180,557 | A * | 4/1965 | Thulin | 383/8 |
| 3,568,918 | A | 3/1971 | Blomqvist | |
| 3,593,622 | A | 7/1971 | Sengewald | |
| 4,076,121 | A | 2/1978 | Clayton et al. | |
| 4,464,157 | A * | 8/1984 | Benoit et al. | 493/211 |
| 4,592,938 | A * | 6/1986 | Benoit | 428/35.5 |
| 4,676,378 | A | 6/1987 | Baxley et al. | |
| 4,747,703 | A | 5/1988 | Cazes | |
| 4,785,938 | A | 11/1988 | Benoit, Jr. et al. | |
| 4,796,759 | A | 1/1989 | Schisler | |
| 4,811,417 | A | 3/1989 | Prince et al. | |
| 4,812,055 | A | 3/1989 | Prader et al. | |
| 4,877,473 | A | 10/1989 | Snowdon et al. | |
| 4,981,216 | A | 1/1991 | Wilfong, Jr. | |
| 5,011,298 | A | 4/1991 | Bose et al. | |
| 5,074,674 | A | 12/1991 | Kuklies et al. | |
| 5,188,235 | A | 2/1993 | Pierce et al. | |
| 5,207,328 | A | 5/1993 | Bose et al. | |
| 5,307,935 | A | 5/1994 | Kemanjian | |

(Continued)

FOREIGN PATENT DOCUMENTS

| | | | |
|---|---|---|---|
| GB | 2264690 | * | 8/1993 |

*Primary Examiner* — N. Edwards

(74) *Attorney, Agent, or Firm* — David A. Belasco; Belasco Jacobs & Townsley, LLP

(57) ABSTRACT

Improved merchandise bag with reinforced bag wall is formed of thinner than normal specially selected film material with a thickened center section. For merchandise bags, the thickened center section provides a stronger bag bottom and stronger areas for the formation of bag handles. Handle bags include soft loop, round die cut oval die cut, wave top, patch and rigid handles. For T-shirt style bags, thinner plastic in the gusset and handle areas is made up for by multiple layers of film in these regions. T-shirt bags may have single, triple or folded gussets providing as many as eight layers of film in these regions. The thickened center section will substantially match the thickness of the gusseted areas and provide for a more easily stacked bag. The bags are formed of mono layer or multi-layer film and at least a portion of the bag walls is corona treated to improve adhesion.

57 Claims, 17 Drawing Sheets

(56) References Cited

U.S. PATENT DOCUMENTS

| | | | |
|---|---|---|---|
| 5,323,909 | A | 6/1994 | Piraneo et al. |
| 5,363,965 | A | 11/1994 | Nguyen |
| 5,464,098 | A | 11/1995 | Tseng et al. |
| 5,469,970 | A | 11/1995 | Li |
| 5,690,228 | A | 11/1997 | DeMatteis |
| 5,865,313 | A | 2/1999 | Huang et al. |
| 5,981,028 | A | 11/1999 | Sugawa et al. |
| 6,079,877 | A | 6/2000 | Chew |
| 6,269,950 | B1 | 8/2001 | Nguyen |
| 6,446,810 | B1 | 9/2002 | Huang et al. |
| 6,767,317 | B2 | 7/2004 | Simhaee |
| 2004/0022456 | A1 | 2/2004 | Hanson |
| 2004/0136622 | A1 | 7/2004 | Shigeta et al. |
| 2004/0184682 | A1 | 9/2004 | Lovold |
| 2005/0220376 | A1 | 10/2005 | Tsukanome et al. |
| 2007/0104905 | A1 | 5/2007 | Floyd, Jr. |

* cited by examiner

| | MD TEAR 0.4 MIL | | TD TEAR 0.4 MIL | | MD TEAR 0.8 MIL | | TD TEAR 0.8 MIL | |
|---|---|---|---|---|---|---|---|---|
| No. | 800gr | 400gr | 800gr | 400gr | 800gr | 400gr | 800gr | 400gr |
| 1 | 3.2 | 4.8 | 40 | 70 | 12 | 11.2 | 52 | 164 |
| 2 | 5.6 | 4.8 | 40 | 56 | 10.4 | 11.2 | 180 | 48 |
| 3 | 4 | 6.4 | 32 | 43 | 11.2 | 12 | 59 | 177 |
| 4 | 5.6 | 4.8 | 70 | 53 | 11.2 | 10.4 | 48 | 128 |
| 5 | 4.8 | 4 | 36 | 40 | 9.6 | 12 | 148 | 59 |
| 6 | 4 | 4 | 56 | 41 | 12.8 | 13.6 | 163 | 148 |
| 7 | 5.6 | 4.8 | 70 | 68 | 10.4 | 12.8 | 60 | 54 |
| 8 | 4 | 5.6 | 41 | 70 | 11.2 | 12.8 | 169 | 96 |
| 9 | 4.8 | 4 | 57 | 50 | 12 | 10.4 | 49 | 49 |
| 10 | 4 | 5.6 | 62 | 48 | 10.4 | 12 | 59 | 96 |
| AVG | 4.56 | 4.88 | 50.4 | 53.9 | 11.12 | 11.68 | 99 | 99 |
| S.DV | 0.85 | 0.8 | 14 | 12 | 0.95 | 1 | 57 | 51 |
| MIN | 3.2 | 4 | 32 | 40 | 9.6 | 10.4 | 49 | 48 |
| MAX | 5.6 | 6.4 | 70 | 70 | 12.8 | 13.6 | 180 | 177 |

BAGS WITH REINFORCED BAG WALLS

RELATED APPLICATION

This application is a Continuation-in-Part of U.S. application Ser. No. 12/845,667, filed Jul. 28, 2010 and currently pending.

FIELD OF INVENTION

This invention relates to the field of merchandise bags formed from thermoplastic and plastic substitute materials and more specifically to bags designed to provide optimal strength and carrying capacity while using a reduced amounts of such materials.

BACKGROUND OF THE INVENTION

Film merchandise bags are manufactured from petroleum products and various organic material substitutes, all of which are increasingly expensive resources. It is difficult to produce such bags in formulations that are easily biodegradable. As the quantity of merchandise used daily is enormous, the production and disposal of these bags has a significant effect on the environment. For these reasons, it is desirable to produce merchandise bags that use a minimum of thermoplastic or plastic-substitute material. Some of the materials presently in use or contemplated for merchandise bags include high density polyethylene, medium density polyethylene, low density polyethylene, linear low density polyethylene, polypropylene, polylactic acid (PLA), poly-3-hydroxybutyrate (PHB), bio-derived polyethylene including materials produced from corn, sugar cane, tapioca, and potatoes and genetically modified bioplastics.

One way to minimize the use of these materials is to use a thinner gauge film in the manufacture of the bags. As merchandise bags used in the grocery and supermarket environments are often used to carry heavy loads of canned goods and other items that may have sharp edges, these merchandise bags need to have a certain minimum resistance to piercing and tearing under such conditions. Use of thinner film in bag construction can result in torn or burst bags, a situation that is not acceptable to retail stores and their customers.

The typical merchandise bag used in the grocery and supermarket setting is the T-Shirt style bag. This bag has a U-shaped open mouth at the upper end with a pair of strap handles extending upwardly from the mouth. In order to make the handles stronger, side gussets are typically formed prior to sealing the upper and lower edges of the bag and forming the bag mouth. This provides four layers of film material in the bag handles compared with two layers for the front and back walls of the bag. High stress areas in merchandise bags include the bag handles and the bottom of the bag, both points at which maximum tensile stress is experienced. In the present invention, several techniques may be employed to increase strength in these critical areas when using a thinner gauge film material in bag construction. These techniques include thickening one or more of the bag walls in specified locations and multiplying the layers of film material in the bag handles. Various inventions have been developed to increase strength of plastic bags.

U.S. Pat. No. 5,338,118, issued to DeMatteis is directed to a plastic bag having an aperture serving as a handle which has a contour of peaks and valleys. The peaks fold in an accordion-like manner when pressed by fingers to cushion the fingers. The area surrounding the bag handle opening is formed with a thicker plastic extrusion while the balance of the bag is of a standard thickness, lending strength to the handle area of the bag.

U.S. Pat. No. 7,223,016, issued to Bell illustrates a collapsed bag of unitary construction made of supple polymeric material, having first and second opposed contiguous flat sidewalls joined at edges and at the bottom but free or with user-releasable weakening at upper edges. The upper edges define a bag mouth. Appropriately situated graspable points at or near bag edges allow the sidewalls to be tensioned or snapped in opposing directions thereby causing the interlayer cling, to which supple polymeric bags are renownedly susceptible, to be readily disrupted for the full distance of contact between the tensioning points and thus for virtually the entirety of the bag mouth to be opened. Performance of this bag opening feature can be improved in a square-topped bag by thickening the plastic material in the area of the bag mouth.

U.S. Pat. No. 6,565,794, issued to Fraser discloses a tie bag having improved tie features provided by increasing the thickness of the tie features as compared to the bag thickness.

It is an objective of the present invention to provide a film merchandise bag having size and strength characteristics of a standard bag that can be manufactured using substantially less film material. It is another objective to provide such a bag manufactured from a thinner gauge film. It is a further objective of the invention to provide a bag that will have a more uniform thickness across the bag width, to aid in storage and packing of bag stacks. It is still a further objective to provide a bag that is resistant to failure along the bottom seam. It is yet a further objective to provide bag designs that are adaptable to use with or without dispensing racks. Finally, it is an objective of the present invention to provide durable bags that are more easily biodegraded and are economical to produce.

While some of the objectives of the present invention are disclosed in the prior art, none of the inventions found include all of the requirements identified.

SUMMARY OF THE INVENTION

The present invention addresses all of the deficiencies of prior art merchandise bag with reinforced bag wall inventions and satisfies all of the objectives described above.

(1) An improved merchandise bag providing the desired features may be constructed from the following components. A typical merchandise bag includes front and rear walls of thermoplastic or other film material of uniform thickness. Each of the front and rear walls has first and second side edges, a top edge and a bottom edge. The front and rear walls are joined at the first and second side edges. A first lower seam is provided. The first lower seam seals the bottom edge of the front wall, and the bottom edge of the rear wall together. The improvement provides that at least one of the front and rear walls has an area of increased thickness and specially selected film material. The area of increased thickness extends from the top edge to the bottom edge and from a first point spaced inwardly from the first side edge by at least a first predetermined distance to a second point spaced inwardly from the second side edge by at least the first predetermined distance. The film material including about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

(2) In a variant of the invention, the improved merchandise bag further includes 0.5 wt. % slip and antiblock compound.

(3) In another variant, the improved merchandise bag further includes 1-3 wt. % calcium carbonate.

(4) In still another variant, the improved merchandise bag further includes 10-20 wt. % recycled material. The recycled material includes about 40-48 wt. % high density, high molecular weight polyethylene, 12-20 wt. % high density, medium molecular weight polyethylene, 20-30 wt. % linear low density polyethylene, 0-8 wt. % color concentrate.

(5) In yet another variant, 10-15 wt. % of the linear low density polyethylene has a density ranging from 0.923-0.924 gm/cc.

(6) In a further variant, 10-15 wt. % of the linear low density polyethylene has a melt index ranging from 0.25-0.30 gm/10 minutes.

(7) In still a further variant, the high density, medium molecular weight polyethylene has a density ranging from 0.937-0.947 gm/cc.

(8) In yet a further variant, the film material includes at least one of polylactic acid (PLA), poly-3-hydroxybutyrate (PHB), bio-derived polyethylene including materials produced from corn, sugar cane, tapioca, and potatoes and genetically modified bioplastics.

(9) In another variant of the invention, the improved merchandise bag includes a second lower seam. The second lower seam is spaced upwardly from the first lower seam by a second predetermined distance.

(10) In still another variant, the improved merchandise bag includes a centrally located handle.

(11) In yet another variant, the handle is selected from the group consisting of soft loop, round die cut, oval die cut, wave top, patch and rigid.

(12) In a further variant, the bag is formed of mono layer or multi-layer film material.

(13) In still a further variant, at least a portion of at least one of the front and rear bag walls is corona treated.

(14) In yet a further variant, the area of increased thickness ranges from 125% to 130% of the thickness of a balance of film material in the bag.

(15) In another variant of the invention, the balance of film material in the bag is 80% to 85% of the thickness of thermoplastic material of the typical merchandise bag.

(16) In still another variant, the bag includes 90% to 92% of the film material of the typical merchandise bag.

(17) In yet another variant the area of increased thickness is 8% to 15% thicker than the film material of the typical merchandise bag.

(18) In a further variant of the invention, an improved gusseted merchandise bag is described. A typical gusseted merchandise bag includes front and rear walls of film material of uniform thickness. Each of the front and rear walls has first and second side edges, a top edge and a bottom edge. First and second side gussets are provided. The side gussets have upper and lower edges and extend inwardly from the first and second side edges of the front and rear walls for a first predetermined distance. A first lower seam is provided. The first lower seam seals the bottom edge of the front wall, lower edges of the first and second side gussets and the bottom edge of the rear wall together. The improvement provides that at least one of the front and rear walls has an area of increased thickness and specially selected film material. The area of increased thickness extends from the top edge to the bottom edge and from a first point spaced inwardly from the first side edge by at least the first predetermined distance to a second point spaced inwardly from the second side edge by at least the first predetermined distance. The film material includes about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

(19) In still a further variant of the invention, the improved merchandise bag further includes 0.5 wt. % slip and antiblock compound.

(20) In yet a further variant, the improved merchandise bag further includes 1-3 wt. % calcium carbonate.

(21) In another variant, the improved merchandise bag further includes 10-20 wt. % recycled material. The recycled material includes about 40-48 wt. % high density, high molecular weight polyethylene, 12-20 wt. % high density, medium molecular weight polyethylene, 20-30 wt. % linear low density polyethylene, 0-8 wt. % color concentrate.

(22) In still another variant, 10-15 wt. % of the linear low density polyethylene has a density ranging from 0.923-0.924 gm/cc.

(23) In yet another variant, 10-15 wt. % of the linear low density polyethylene has a melt index ranging from 0.25-0.30 gm/10 minutes.

(24) In a further variant, the high density, medium molecular weight polyethylene has a density ranging from 0.937-0.947 gm/cc.

(25) In still a further variant, the film material includes at least one of polylactic acid (PLA), poly-3-hydroxybutyrate (PHB), bio-derived polyethylene including materials produced from corn, sugar cane, tapioca, and potatoes and genetically modified bioplastics.

(26) In another variant, a second lower seam is provided. The second seam is spaced upwardly from the first lower seam by a second predetermined distance.

(27) In another variant, the improved gusseted merchandise bag includes a centrally located handle.

(28) In still another variant, the handle is selected from the group consisting of soft loop, round die cut, oval die cut, wave top, patch and rigid.

(29) In yet another variant, the improved gusseted bag is formed of mono layer or multi-layer film material.

(30) In a further variant, at least a portion of at least one of the front and rear bag walls is corona treated.

(31) In still a further variant, the area of increased thickness ranges from 125% to 130% of the thickness of a balance of film material in the bag.

(32) In another variant of the invention, the balance of film material in the bag is 80% to 85% of the thickness of film material of the typical gusseted merchandise bag.

(33) In still another variant, the bag includes 90% to 92% of the film material of the typical gusseted merchandise bag.

(34) In yet another variant the area of increased thickness is 8% to 15% thicker than the film material of the typical gusseted merchandise bag.

(35) An improved T-Shirt style bag providing the desired features may be constructed from the following components. A typical T-Shirt style bag includes front and rear walls of film material of uniform thickness. Each of the front and rear walls has first and second side edges, a top edge and a bottom edge. First and second side gussets are provided. The side gussets have upper and lower edges and extend inwardly from the first and second side edges of the front and rear walls for a first predetermined distance.

An upper seam is provided. The upper seam seals the top edge of the front wall, upper edges of the first and second side gussets and the top edge of the rear wall together. A first lower seam is provided. The first lower seam seals the bottom edge of the front wall, lower edges of the first and second side gussets and the bottom edge of the rear wall together. A U-shaped cut-out is provided. The U-shaped cut-out is located in an upper portion of the bag and commences at a first point along the top edge spaced inwardly from the first side edge and extending to a second point along the top edge spaced inwardly from the second side edge, the cut-out extending downwardly toward the bottom edges, thereby forming an open mouth portion and a pair of bag handles. The improvement provides that at least one of the front and rear walls has an area of increased thickness and specially selected film material. The area of increased thickness extends from the open mouth portion to the bottom edge and from a first point spaced inwardly from the first side edge by at least the first predetermined distance to a second point spaced inwardly from the second side edge by at least the first predetermined distance. The film material includes about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

(36) In a variant of the invention, the improved T-Shirt style bag further includes 0.5 wt. % slip and antiblock compound.

(37) In another variant, the improved T-Shirt style bag further includes 1-3 wt. % calcium carbonate.

(38) In still another variant, the improved T-Shirt style bag further includes 10-20 wt. % recycled material. The recycled material includes about 40-48 wt. % high density, high molecular weight polyethylene, 12-20 wt. % high density, medium molecular weight polyethylene, 20-30 wt. % linear low density polyethylene, 0-8 wt. % color concentrate.

(39) In yet another variant, 10-15 wt. % of the linear low density polyethylene has a density ranging from 0.923-0.924 gm/cc.

(40) In a further variant, 10-15 wt. % of the linear low density polyethylene has a melt index ranging from 0.25-0.30 gm/10 minutes.

(41) In still a further variant, the high density, medium molecular weight polyethylene has a density ranging from 0.937-0.947 gm/cc.

(42) In yet a further variant, the film material includes at least one of polylactic acid (PLA), poly-3-hydroxybutyrate (PHB), bio-derived polyethylene including materials produced from corn, sugar cane, tapioca, and potatoes and genetically modified bioplastics.

(43) In another variant of the invention, a third side gusset is provided. The third side gusset has an upper edge and a lower edge and extends inwardly from the first side edge of the front wall for a second predetermined distance and outwardly for a third predetermined distance to join the first side gusset. A fourth side gusset is provided. The fourth side gusset has an upper edge and a lower edge and extends inwardly from the first side edge of the rear wall for the second predetermined distance and outwardly for the third predetermined distance to join the first side gusset. A fifth side gusset is provided. The fifth side gusset has an upper edge and a lower edge and extends inwardly from the second side edge of the front wall for the second predetermined distance and outwardly for the third predetermined distance to join the second side gusset. A sixth side gusset is provided. The sixth side gusset has an upper edge and a lower edge and extends inwardly from the second side edge of the rear wall for the second predetermined distance and outwardly for the third predetermined distance to join the second side gusset. The upper seam seals the top edge of the front wall, upper edges of the first, second, third, fourth, fifth and sixth side gussets and the top edge of the rear wall together. The first lower seam seals the bottom edge of the front wall, lower edges of the first, second, third, fourth, fifth and sixth side gussets and the bottom edge of the rear wall together.

(44) In still another variant, a first folded portion is provided. The first folded portion has an upper edge and a lower edge and is folded into the first side gusset from the first side edge of the front wall for a second predetermined distance. A second folded portion is provided. The second folded portion has an upper edge and a lower edge and is folded into the first side gusset from the first side edge of the rear wall for the second predetermined distance. A third folded portion is provided. The third folded portion has an upper edge and a lower edge and is folded into the second side gusset from the second side edge of the front wall for the second predetermined distance. A fourth folded portion is provided. The fourth folded portion has an upper edge and a lower edge and is folded into the second side gusset from the second side edge of the rear wall for the second predetermined distance. The upper seam seals the top edge of the front wall, upper edges of the first and second side gussets, upper edges of the first, second, third and fourth folded portions and the top edge of the rear wall together. The first lower seam seals the bottom edge of the front wall, lower edges of the first and second side gussets, lower edges of the first, second, third and fourth folded portions and the bottom edge of the rear wall together.

(45) In yet another variant, first and second openings are provided. The first and second openings penetrate and extend transversely through each of the bag handles. The openings are spaced downwardly from the top edge, spaced inwardly from the first and second side edges and serve to support the bag on horizontal arms of a dispensing rack.

(46) In a further variant, at least a portion of at least one of the front and rear bag walls is corona treated.

(47) In still a further variant, a central tab portion connected to the open mouth portion of the bag is provided. An aperture is provided. The aperture extends transversely through the bag within the central tab portion for suspending the bag from a dispensing rack.

(48) In yet a further variant, the central tab portion is attached to the open mouth portion with a frangible section. The frangible section breaks when the bag is pulled from a dispensing rack.

(49) In another variant of the invention, the aperture in the central tab portion includes a frangible portion. The frangible portion breaks when the bag is pulled from the dispensing rack.

(50) In still another variant, the open mouth portion includes stress relief areas. The stress relief areas have curved inner corners wherein a cut line forming the corners extends from a vertical inner edge of the bag handle outwardly toward one of the first and second side edges, downwardly toward the lower seam and upwardly at a shallow angle toward a center line of the front and rear bag walls, thereby reducing the likelihood that the open mouth portion may tear under tension.

(51) In a further variant, a second lower seam is provided. The second lower seam is spaced upwardly from said first lower seam by a second predetermined distance.

(52) In still a further variant, the area of increased thickness ranges from 125% to 130% of the thickness of a balance of film material in the bag.

(53) In yet a further variant of the invention, the balance of film material in the bag is 80% to 85% of the thickness of film material of the typical merchandise bag.

(54) In another variant, the bag includes 90% to 92% of the film material of the typical T-Shirt style bag.

(55) In still another variant the area of increased thickness is 8% to 15% thicker than the film material of the typical T-Shirt style bag.

(56) In yet another variant, the improved T-Shirt style bag further includes at least one pair of additional first side edge gussets. Each of the first side edge gussets has an upper edge and a lower edge and extends inwardly from the first side edge of either the front wall, the rear wall or one of the additional first side edge gussets for a second predetermined distance and outwardly for a third predetermined distance to join either the first side gusset or one of the additional first side edge gussets. The improved T-Shirt style bag also further includes at least one pair of additional second side edge gussets. Each of the second side edge gussets has an upper edge and a lower edge and extends inwardly from the second side edge of either the front wall, the rear wall or one of the additional second side edge gussets for the second predetermined distance and outwardly for the third predetermined distance to join either the second side gusset or one of the additional second side edge gussets.

The upper seam seals the top edge of the front wall, the upper edges of the first and second gussets, at least one pair of additional first side edge gussets, at least one pair of additional second side edge gussets and the top edge of the rear wall together. The lower seam seals the bottom edge of the front wall, the lower edges of the first and second gussets, at least one pair of additional first side edge gussets, at least one pair of additional second side edge gussets and the bottom edge of the rear wall together.

(57) In a final variant, the improved T-Shirt style bag further includes at least one pair of first side folded portions. The first side folded portions have an upper edge and a lower edge and are folded into either the first side gusset or one of the first side folded portions from the first side edge of either the front wall, the rear wall or one of the first side folded portions for a second predetermined distance. The improved T-Shirt style bag also further includes at least one pair of second side folded portions. The second side folded portions have an upper edge and a lower edge and are folded into either the second side gusset or one of the second side folded portions from the second side edge of either the front wall, the rear wall or one of the second side folded portions for the second predetermined distance.

The upper seam seals the top edge of the front wall, the upper edges of the first and second side gussets, the upper edges of the at least one pair of first side folded portions and the at least one pair of second side folded portions and the top edge of the rear wall together. The lower seam seals the bottom edge of the front wall, the lower edges of the first and second side gussets, the lower edges of the at least one pair of first side folded portions and the at least one pair of second side folded portions and the bottom edge of the rear wall together.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-10 illustrate an improved merchandise bag 8 providing the desired features that may be constructed from the following components. As illustrated in FIGS. 1A and 2A, a typical merchandise bag 4 includes front 12 and rear 16 walls of film material 15 of uniform thickness 6. Each of the front 12 and rear 16 walls has first 20 and second 24 side edges, a top edge 28 and a bottom edge 32. The front 12 and rear 16 walls are joined at the first 20 and second 24 side edges. A first lower seam 36 is provided. The first lower seam 36 seals the bottom edge 32 of the front wall 12, and the bottom edge 32 of the rear wall 16 together. As illustrated in FIGS. 1 and 2, the improvement provides that at least one of the front 12 and rear 16 walls has an area of increased thickness 40 and specially selected film material 15. The area of increased thickness 40 extends from the top edge 28 to the bottom edge 32 and from a first point 44 spaced inwardly from the first side edge 20 by at least a first predetermined distance 48 to a second point 52 spaced inwardly from the second side edge 24 by at least the first predetermined distance 48. The film material 15 including about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

(2) In a variant of the invention, the improved merchandise bag 8 further includes 0.5 wt. % slip and antiblock compound.

(3) In another variant, the improved merchandise bag 8 further includes 1-3 wt. % calcium carbonate.

(4) In still another variant, the improved merchandise bag 8 further includes 10-20 wt. % recycled material. The recycled material includes about 40-48 wt. % high density, high molecular weight polyethylene, 12-20 wt. % high density, medium molecular weight polyethylene, 20-30 wt. % linear low density polyethylene, 0-8 wt. % color concentrate.

(5) In yet another variant, 10-15 wt. % of the linear low density polyethylene has a density ranging from 0.923-0.924 gm/cc.

(6) In a further variant, 10-15 wt. % of the linear low density polyethylene has a melt index ranging from 0.25-0.30 gm/10 minutes.

(7) In still a further variant, the high density, medium molecular weight polyethylene has a density ranging from 0.937-0.947 gm/cc.

(8) In yet a further variant, the film material includes at least one of polylactic acid (PLA), poly-3-hydroxybutyrate (PHB), bio-derived polyethylene including materials produced from corn, sugar cane, tapioca, and potatoes and genetically modified bioplastics.

Figure 1:
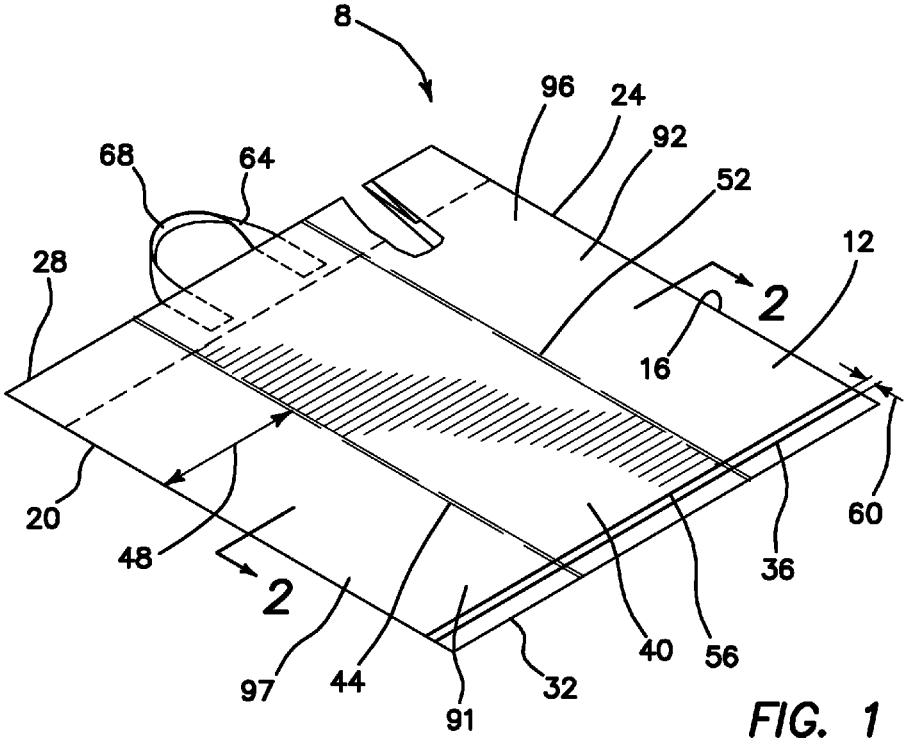
FIG. 1 is a perspective view of the preferred embodiment of the invention illustrating an improved merchandise bag with soft loop handle and area of increased wall thickness.
Figure 3:
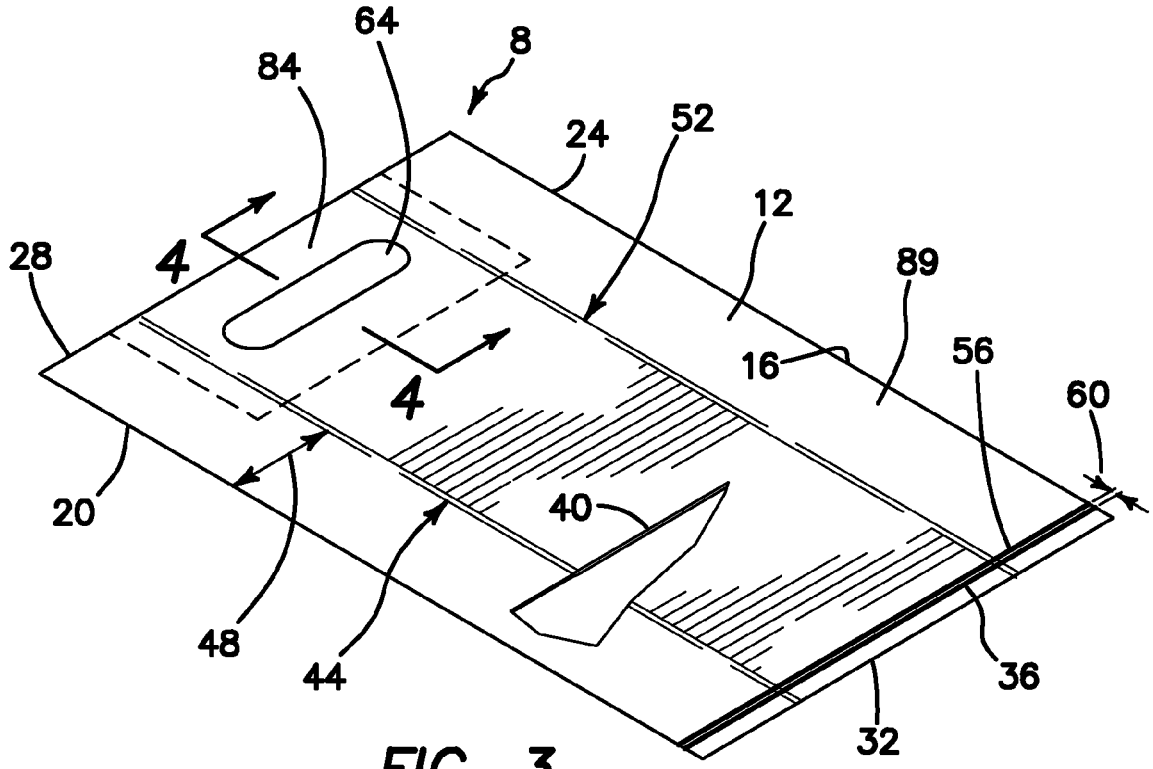
FIG. 3 is a perspective view of a second embodiment featuring a patch handle centered in the reinforced bag wall.

(9) In another variant of the invention, as illustrated in FIGS. 1 and 3, the improved merchandise bag 8 includes a second lower seam 56. The second lower seam 56 is spaced upwardly from the first lower seam 36 by a second predetermined distance 60.

(10) In still another variant, as illustrated in FIGS. 1-10, the improved merchandise bag 8 includes a centrally located handle 64.

(11) In yet another variant, the handle 64 is selected from the group consisting of soft loop 68, round die cut 72, oval die cut 76, wave top 80, patch 84 and rigid 88.

Figure 2:
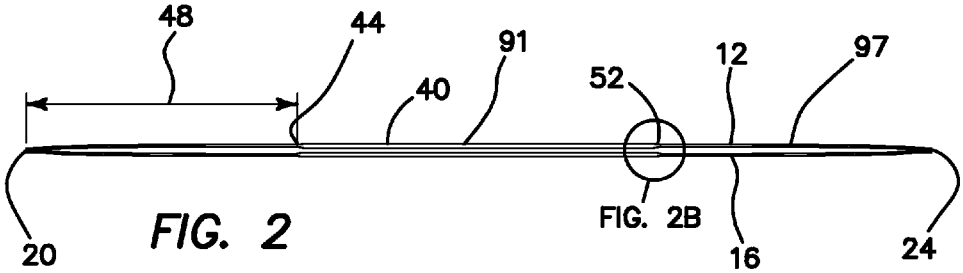
FIG. 2 is a cross-sectional view of the FIG. 1 embodiment taken along the line 2-2.
Figure 2B:
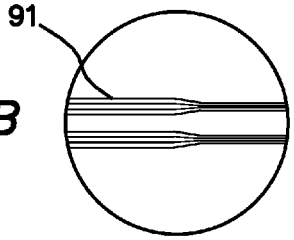
FIG. 2B is an enlarged view of the circled portion of FIG. 2.
Figure 1A:
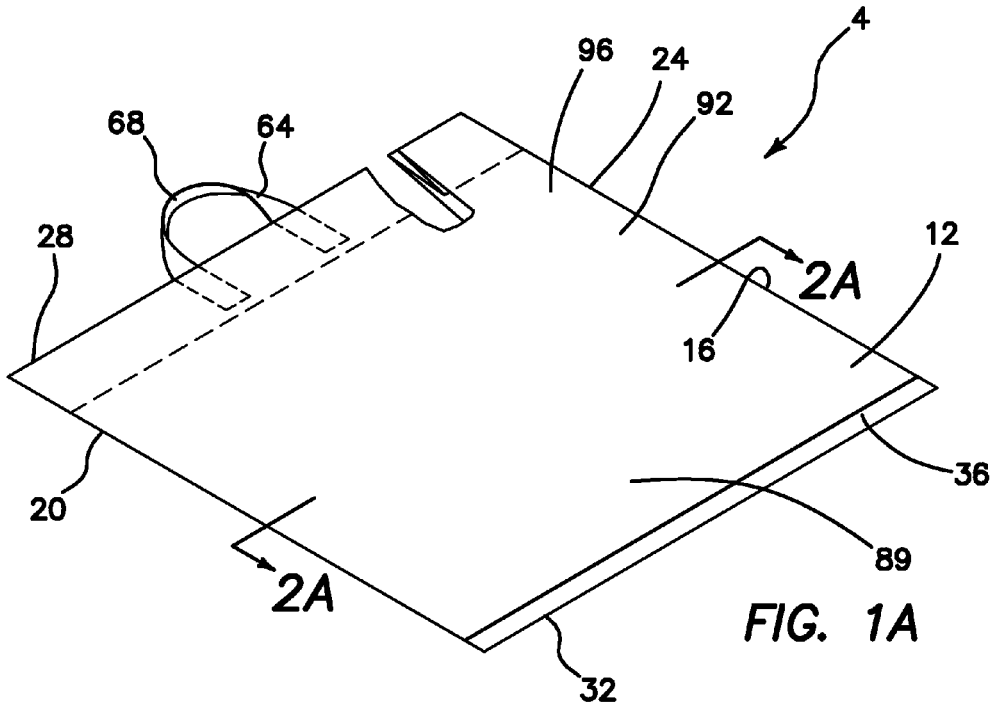
FIG. 1A is a perspective view of a typical merchandise bag having walls of uniform thickness.
Figure 2A:
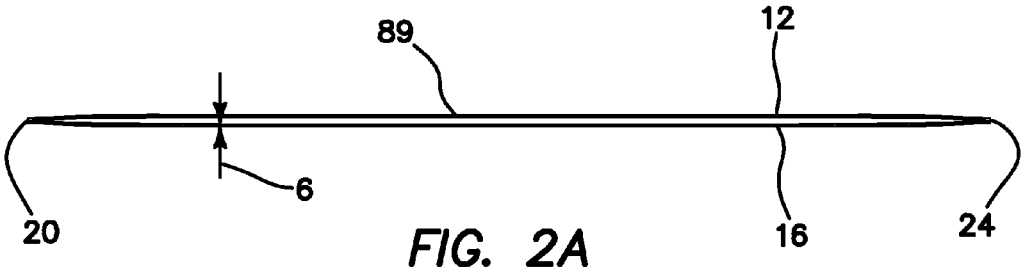
FIG. 2A is a cross-sectional view of the FIG. 1A embodiment taken along the line 2A-2A.

(12) In a further variant, the bag 8 is formed of mono layer 89 or multi-layer 91 film material as shown in FIGS. 2A and 2B, respectively.

(13) In still a further variant, at least a portion 92 of at least one of the front 12 and rear 16 bag walls is corona treated 96.

(14) In yet a further variant, the area of increased thickness 40 ranges from 125% to 130% of the thickness of a balance of film material 97 in the bag 8.

(15) In another variant of the invention, the balance of thermoplastic material 97 in the bag 8 is 80% to 85% of the thickness of film material of the typical merchandise bag 4.

(16) In still another variant, the bag 8 includes 90% to 92% of the film material of the typical merchandise bag 4.

(17) In yet another variant the area of increased thickness 40 is 8% to 15% thicker than the film material of the typical merchandise bag 4.

Figure 9:
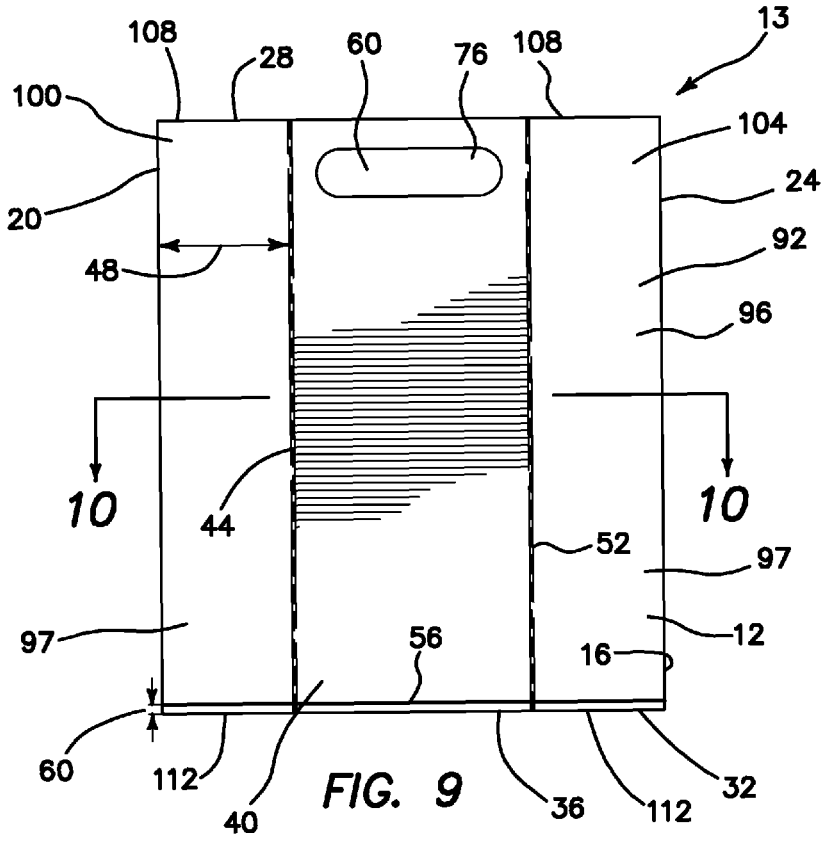
FIG. 9 is a perspective view of a fifth embodiment featuring a pair of side gussets, area of increased wall thickness and an oval die cut handle.
Figure 10:
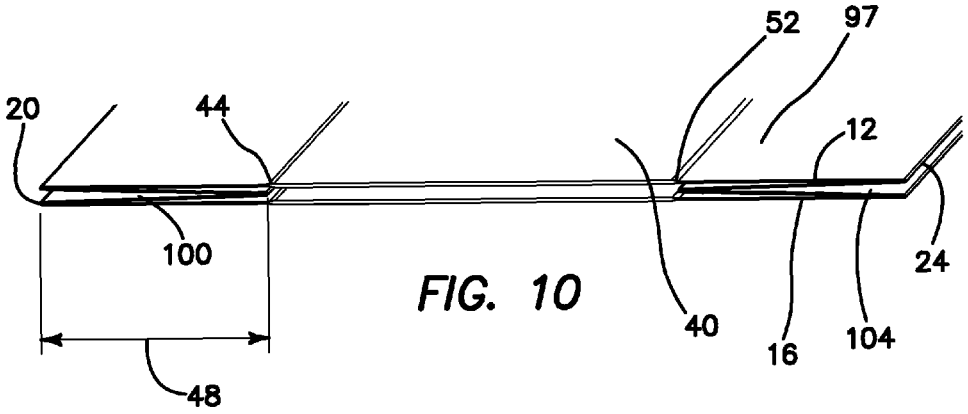
FIG. 10 is a cross-sectional view of the FIG. 9 embodiment taken along the line 10-10.
Figure 9A:
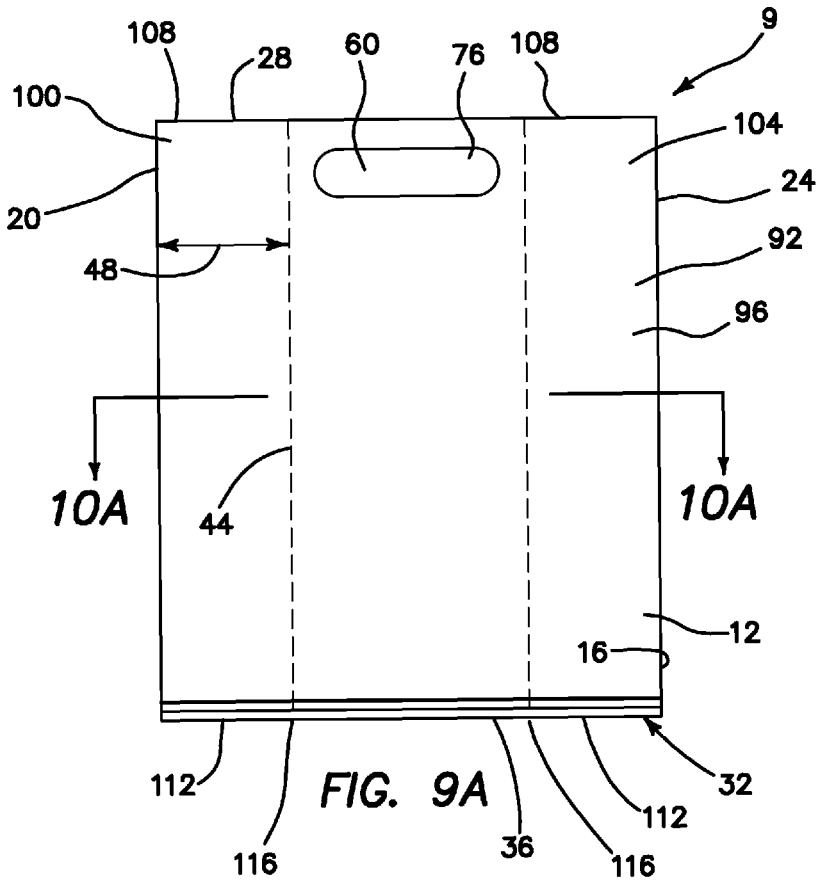
FIG. 9A is a perspective view of a typical gusseted merchandise bag having walls of uniform thickness.
Figure 10A:
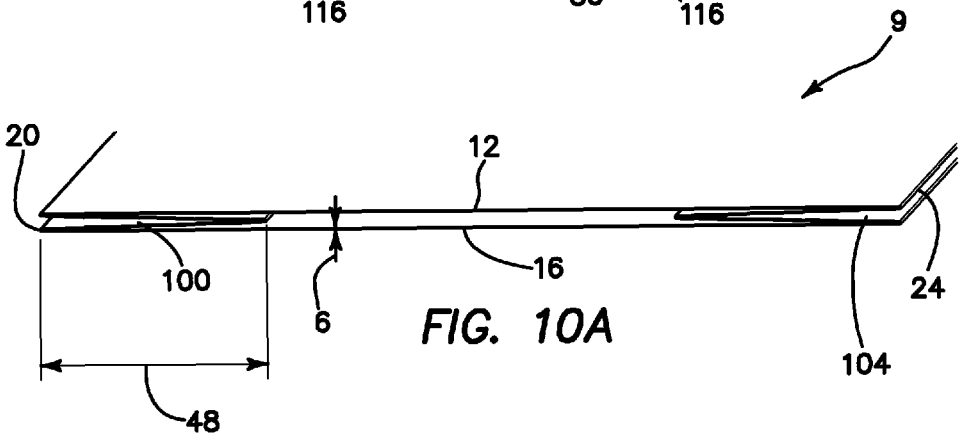
FIG. 10A is a cross-sectional view of the FIG. 9A embodiment taken along the line 10A-10A.

(18) In a further variant of the invention, an improved gusseted merchandise bag 13, is illustrated in FIGS. 9 and 10. As illustrated in FIGS. 9A and 10A, a typical gusseted merchandise bag 9, includes front 12 and rear 16 walls of film material 15 of uniform thickness 6. Each of the front 12 and rear 16 walls has first 20 and second 24 side edges, a top edge 28 and a bottom edge 32. First 100 and second 104 side gussets are provided. The side gussets 100, 104 have upper 108 and lower 112 edges and extend inwardly from the first 20 and second 24 side edges of the front 12 and rear 16 walls for a first predetermined distance 48. A first lower seam 36 is provided. The first lower seam 36 seals the bottom edge 32 of the front wall 12, lower edges 112 of the first 100 and second 104 side gussets and the bottom edge 32 of the rear wall 16 together. As illustrated in FIGS. 9 and 10, the improvement provides that at least one of the front 12 and rear 16 walls has an area of increased thickness 40 and specially selected film material 15. The area of increased thickness 40 extends from the top edge 28 to the bottom edge 32 and from a first point 44 spaced inwardly from the first side edge 20 by at least the first predetermined distance 48 to a second point 52 spaced inwardly from the second side edge 24 by at least the first predetermined distance 48. The film material 15 includes about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

(19) In still a further variant of the invention, the improved merchandise bag 13 further includes 0.5 wt. % slip and antiblock compound.

(20) In yet a further variant, the improved merchandise bag 13 further includes 1-3 wt. % calcium carbonate.

(21) In another variant, the improved merchandise bag 13 further includes 10-20 wt. % recycled material. The recycled material includes about 40-48 wt. % high density, high molecular weight polyethylene, 12-20 wt. % high density, medium molecular weight polyethylene, 20-30 wt. % linear low density polyethylene, 0-8 wt. % color concentrate.

(22) In still another variant, 10-15 wt. % of the linear low density polyethylene has a density ranging from 0.923-0.924 gm/cc.

(23) In yet another variant, 10-15 wt. % of the linear low density polyethylene has a melt index ranging from 0.25-0.30 gm/10 minutes.

(24) In a further variant, the high density, medium molecular weight polyethylene has a density ranging from 0.937-0.947 gm/cc.

(25) In still a further variant, the film material 15 includes at least one of polylactic acid (PLA), poly-3-hydroxybutyrate (PHB), bio-derived polyethylene including materials produced from corn, sugar cane, tapioca, and potatoes and genetically modified bioplastics.

(26) In another variant, a second lower seam 56 is provided. The second lower seam 56 is spaced upwardly from the first lower seam 36 by a second predetermined distance 60.

(27) In another variant, the improved gusseted merchandise bag 13 includes a centrally located handle 64.

(28) In still another variant, as illustrated in FIGS. 1-10, the handle 64 is selected from the group consisting of soft loop 68, round die cut 72, oval die cut 76, wave top 80, patch 84 and rigid 88.

Figure 4:
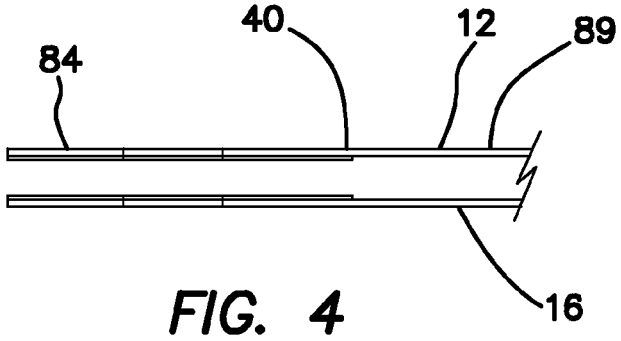
FIG. 4 is a cross-sectional view of the FIG. 3 embodiment taken along the line 4-4.
Figure 5:
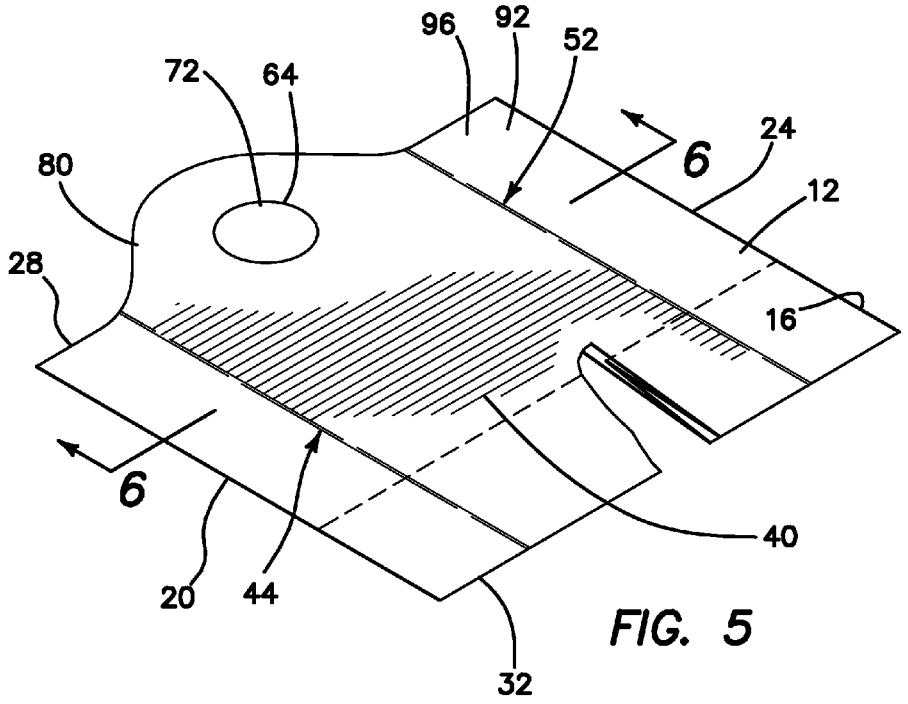
FIG. 5 is a perspective view of a third embodiment featuring a wave top bag mouth and a round die cut handle centered in the reinforced bag wall.
Figure 6:
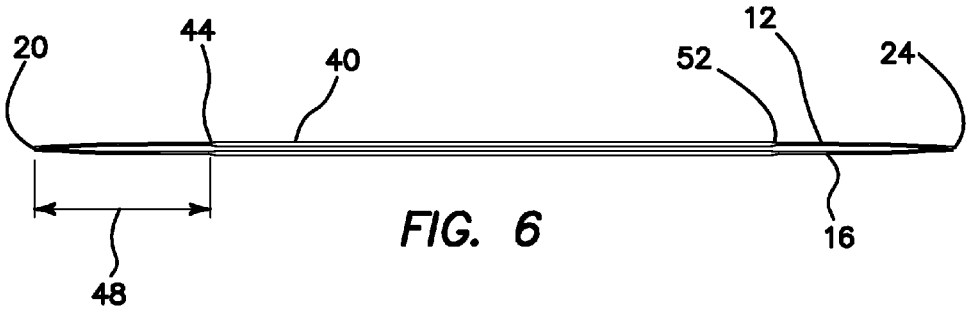
FIG. 6 is a cross-sectional view of the FIG. 5 embodiment taken along the line 6-6.
Figure 7:
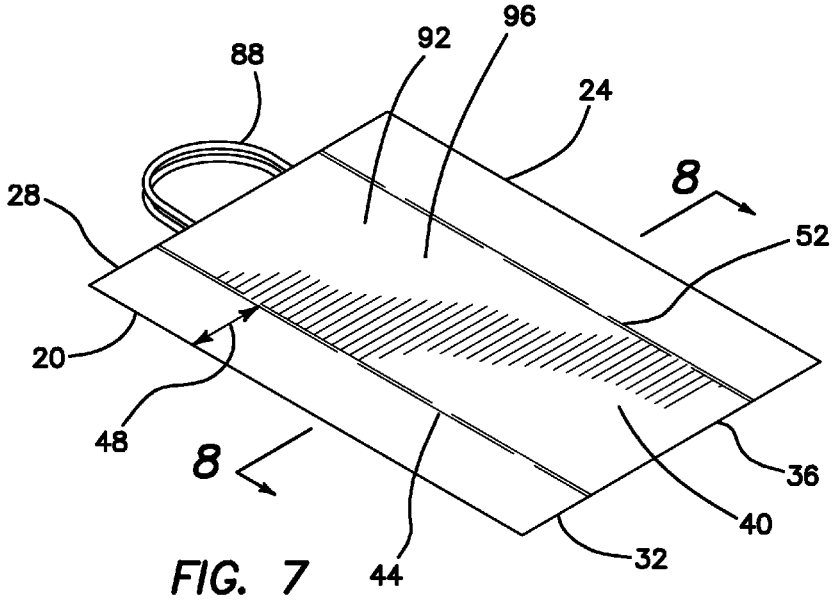
FIG. 7 is a perspective view of a fourth embodiment featuring a rigid handle.
Figure 8:
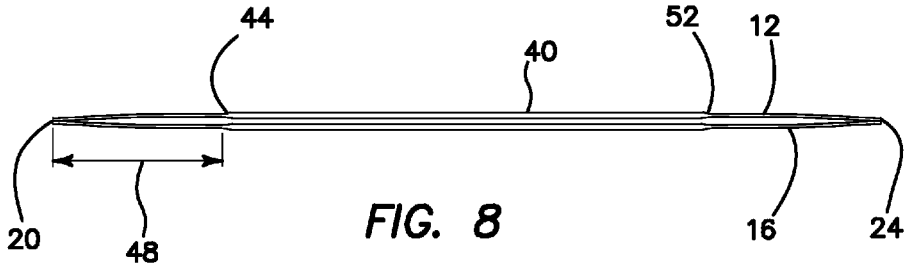
FIG. 8 is a cross-sectional view of the FIG. 7 embodiment taken along the line 8-8.

(29) In yet another variant, the improved bag 8 is formed of mono layer 89, as illustrated in FIGS. 3 and 4, or multi-layer 91 film material, as illustrated in FIGS. 2 and 2B.

(30) In a further variant, at least a portion 92 of at least one of the front 12 and rear 16 bag walls is corona treated 96, as illustrated in FIG. 1.

(31) In still a further variant, as illustrated in FIGS. 9 and 10, the area of increased thickness 40 ranges from 125% to 130% of the thickness of a balance of film material 97 in the bag 13.

(32) In another variant of the invention, the balance of film material 97 in the bag 13 is 80% to 85% of the thickness of film material of the typical gusseted merchandise bag 9.

(33) In still another variant, the bag 13 includes 90% to 92% of the film material of the typical gusseted merchandise bag 9.

(34) In yet another variant the area of increased thickness 40 is 8% to 15% thicker than the film material of the typical gusseted merchandise bag 9.

Figure 13A:
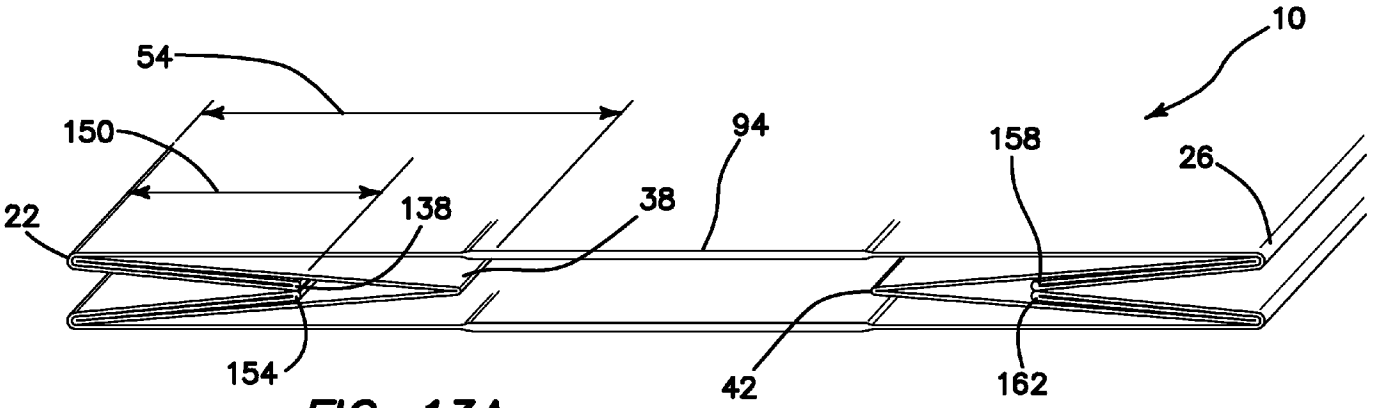
FIG. 13A is a cross-sectional perspective view of the FIG. 11 embodiment taken along the line 13A-13A, illustrating a folded gusset bag.
Figure 13B:
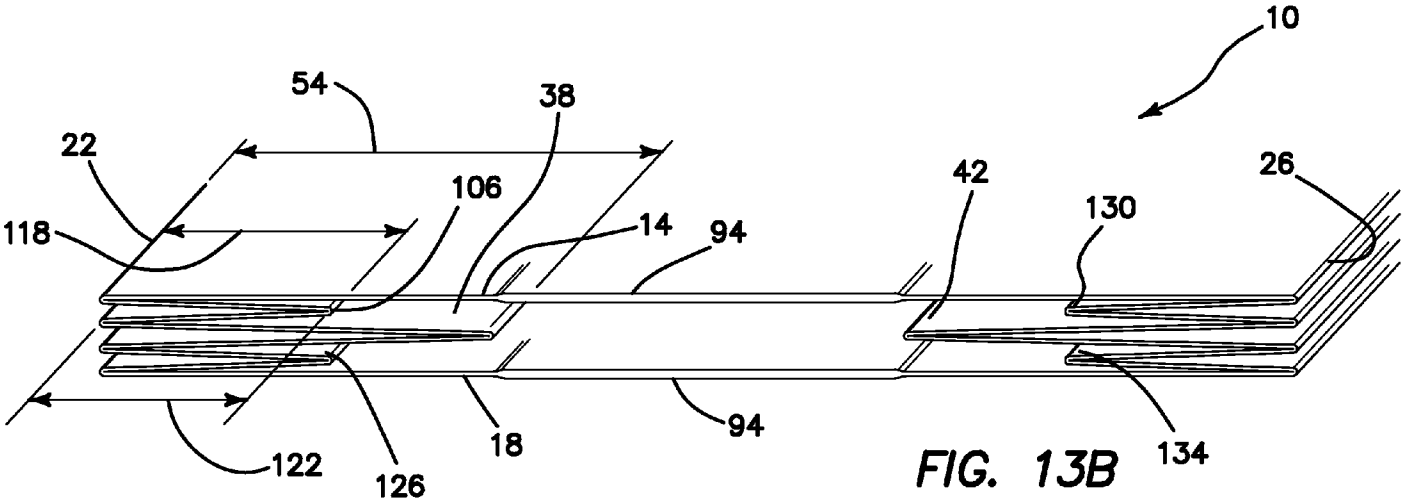
FIG. 13B is a cross-sectional perspective view of the FIG. 11 embodiment taken along the line 13B-13B, illustrating a triple gusseted bag.
Figure 14:
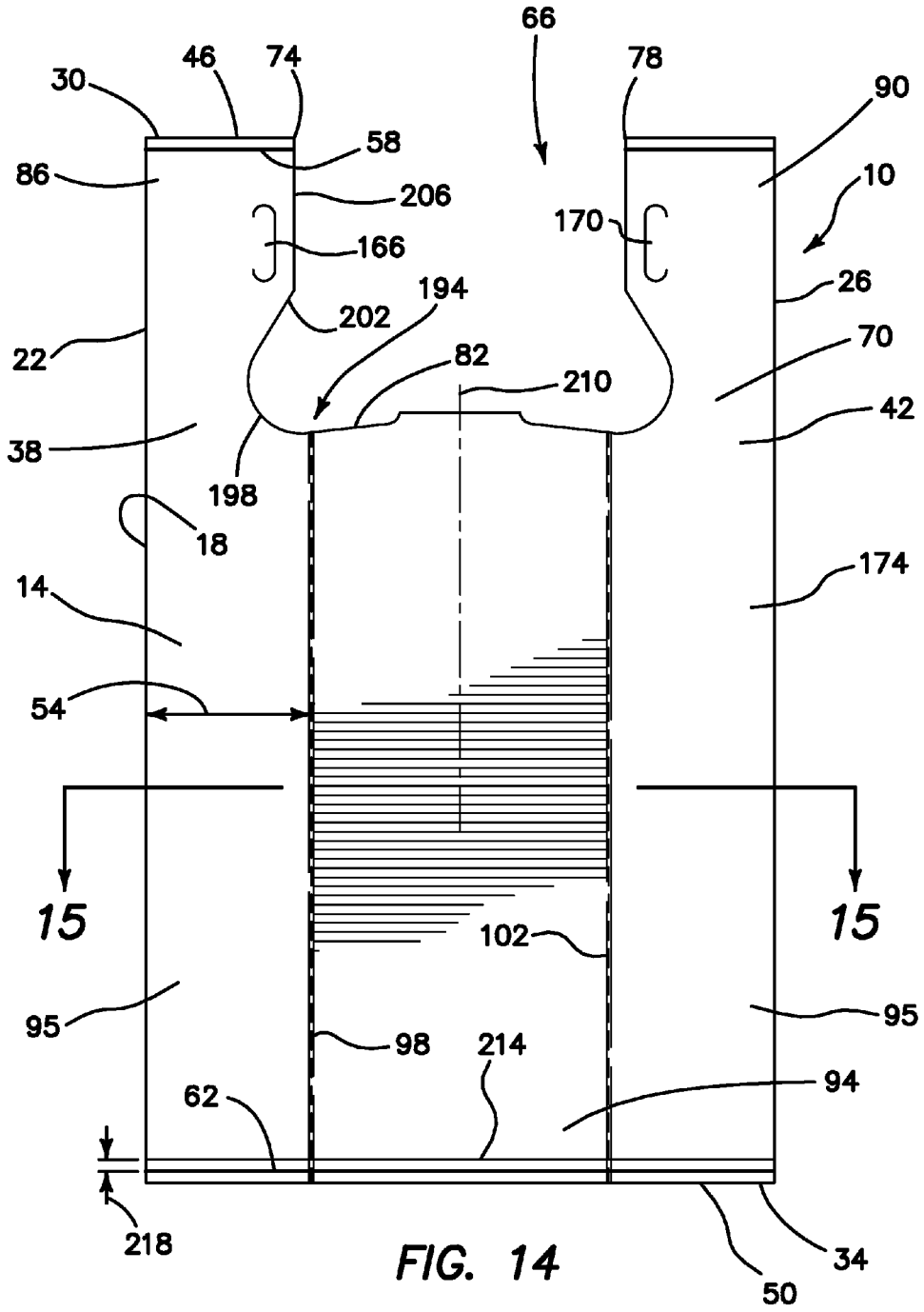
FIG. 14 is a front elevation of the FIG. 11 embodiment illustrating a single gusseted T-Shirt style bag.
Figure 14A:
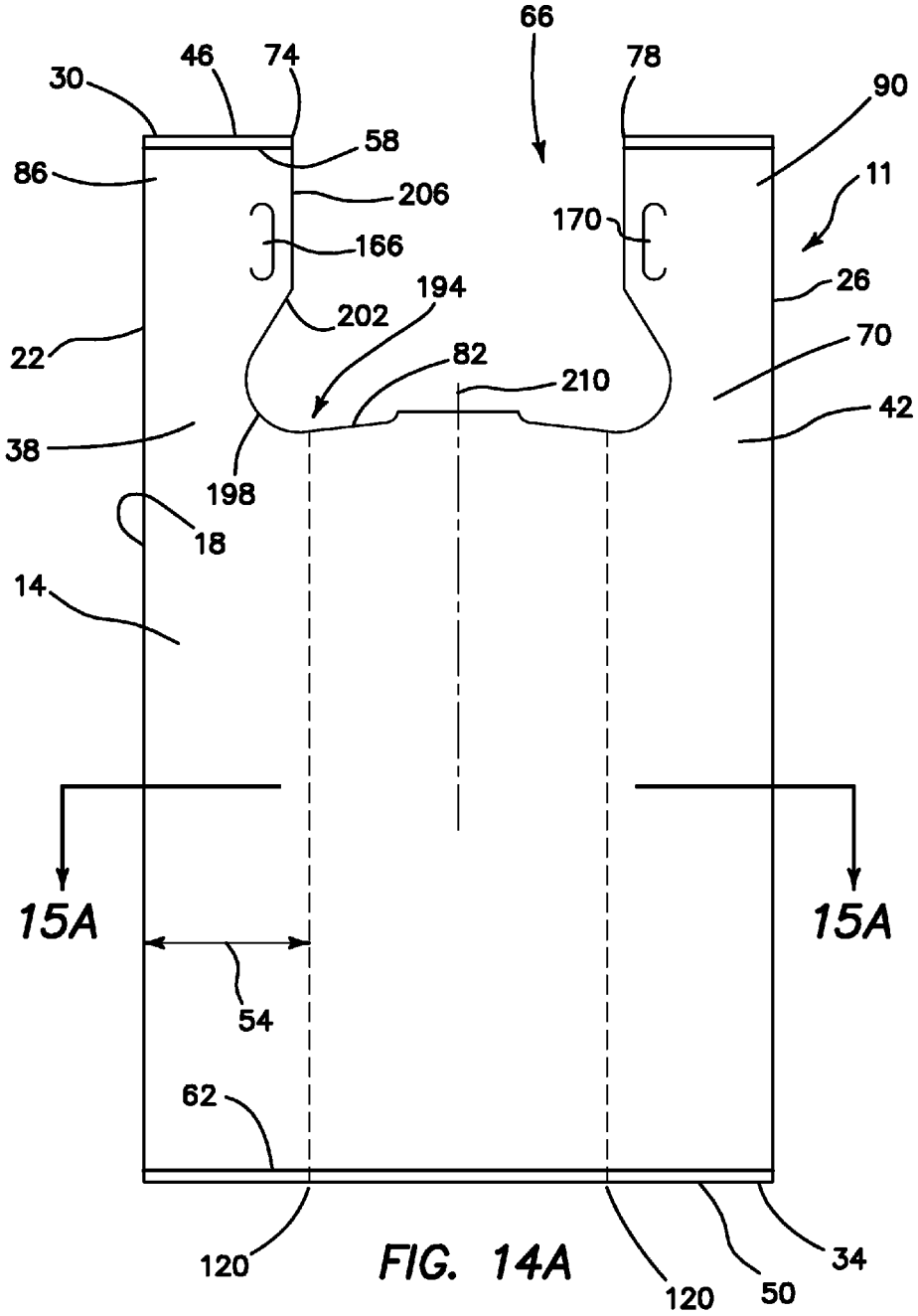
FIG. 14A is a front elevation of a typical, single gusseted T-Shirt style bag having walls of uniform thickness.
Figure 15:
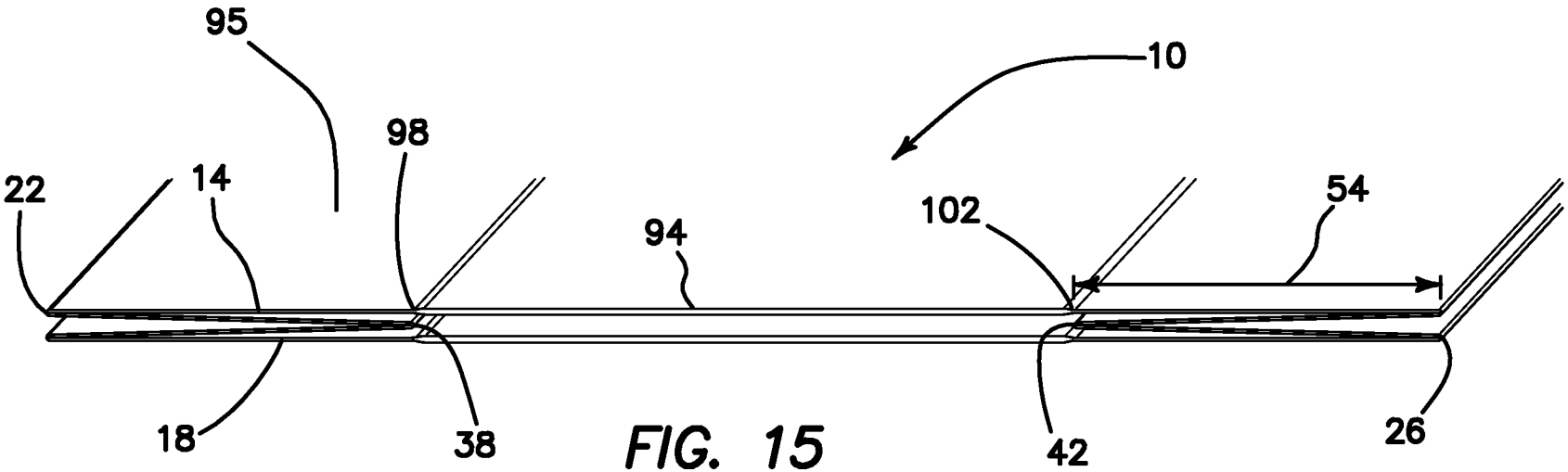
FIG. 15 is a cross-sectional perspective view of the FIG. 14 embodiment taken along the line 15-15, illustrating a single gusset bag.
Figure 15A:
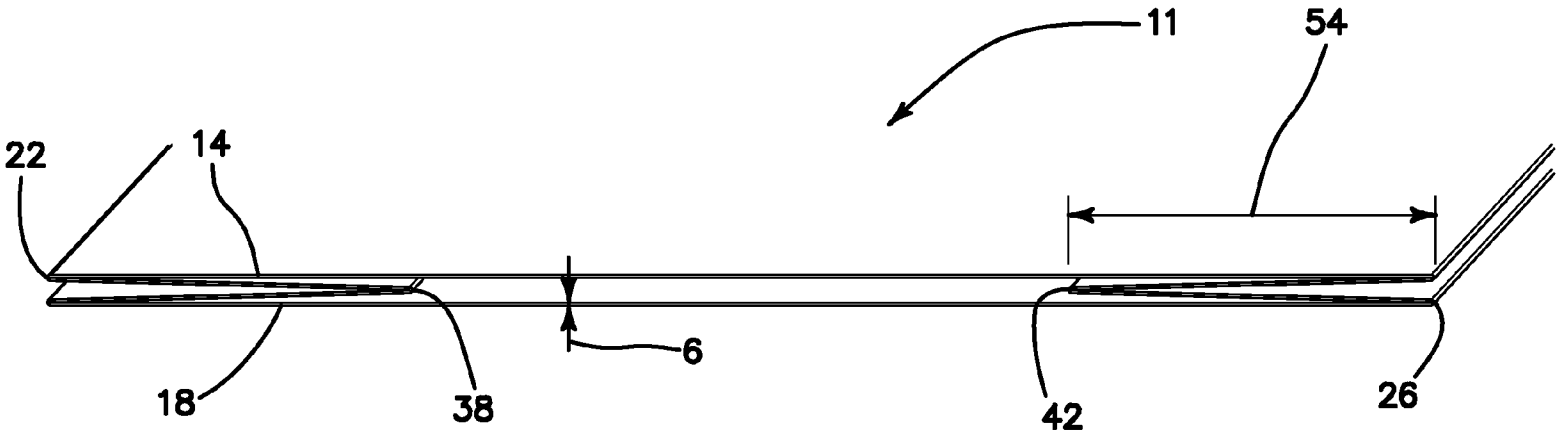
FIG. 15A is a cross-sectional perspective view of the FIG. 14A embodiment taken along the line 15A-15A, illustrating a single gusset bag having walls of uniform thickness.

(35) FIGS. 11-17 illustrate an improved T-Shirt style bag 10 providing the desired features that may be constructed from the following components. As illustrated in FIGS. 14A and 15A, a typical T-Shirt style bag 11 includes front 14 and rear 18 walls of film material 15 of uniform thickness 6. Each of the front 14 and rear 18 walls has first 22 and second 26 side edges, a top edge 30 and a bottom edge 34. First 38 and second 42 side gussets are provided. The side gussets 38, 42 have upper 46 and lower 50 edges and extend inwardly from the first 22 and second 26 side edges of the front 14 and rear 18 walls for a first predetermined distance 54.

An upper seam is provided 58. The upper seam 58 seals the top edge 30 of the front wall 14, upper edges 46 of the first 38 and second 42 side gussets and the top edge 30 of the rear wall 18 together. A first lower seam 62 is provided. The first lower seam 62 seals the bottom edge 34 of the front wall 14, lower edges 50 of the first 38 and second 42 side gussets and the bottom edge 34 of the rear wall 18 together. A U-shaped cut-out 66 is provided. The U-shaped cut-out 66 is located in an upper portion 70 of the bag 11 and commences at a first point 74 along the top edge 30 spaced inwardly from the first side edge 22 and extending to a second point 78 along the top edge 30 spaced inwardly from the second side edge 26, the cut-out 66 extending downwardly toward the bottom edges 34, thereby forming an open mouth portion 82 and a pair of bag handles 86, 90. As illustrated in FIGS. 14 and 15, the improvement provides that at least one of the front 14 and rear 18 walls has an area of increased thickness 94 and specially selected film material 15. The area of increased thickness 94 extends from the open mouth portion 82 to the bottom edge 34 and from a first point 98 spaced inwardly from the first side edge 22 by at least the first predetermined distance 54 to a second point 102 spaced inwardly from the second side edge 26 by at least the first predetermined distance 54. The film material 15 includes about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

(36) In a variant of the invention, the improved T-Shirt style bag 10 further includes 0.5 wt. % slip and antiblock compound.

(37) In another variant, the improved T-Shirt style bag 10 further includes 1-3 wt. % calcium carbonate.

(38) In still another variant, the improved T-Shirt style bag 10 further includes 10-20 wt. % recycled material. The recycled material includes about 40-48 wt. % high density, high molecular weight polyethylene, 12-20 wt. % high density, medium molecular weight polyethylene, 20-30 wt. % linear low density polyethylene, 0-8 wt. % color concentrate.

(39) In yet another variant, 10-15 wt. % of the linear low density polyethylene has a density ranging from 0.923-0.924 gm/cc.

(40) In a further variant, 10-15 wt. % of the linear low density polyethylene has a melt index ranging from 0.25-0.30 gm/10 minutes.

(41) In still a further variant, the high density, medium molecular weight polyethylene has a density ranging from 0.937-0.947 gm/cc.

(42) In yet a further variant, the film material 15 includes at least one of polylactic acid (PLA), poly-3-hydroxybutyrate (PHB), bio-derived polyethylene including materials produced from corn, sugar cane, tapioca, and potatoes and genetically modified bioplastics.

Figure 12:
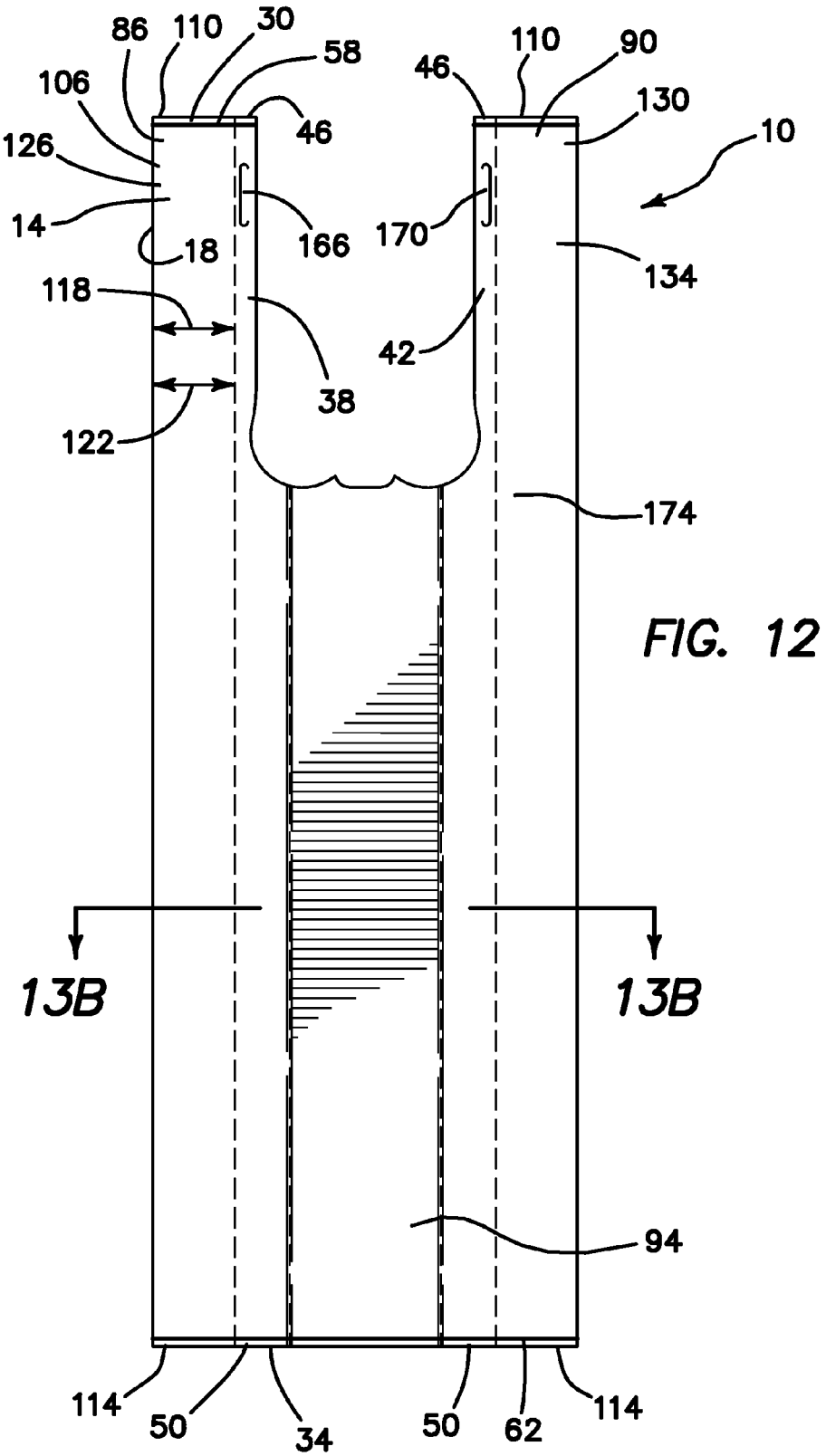
FIG. 12 is a front elevation of the FIG. 11 embodiment.

(43) In a variant of the invention, as illustrated in FIGS. 12 and 13B, a third side gusset 106 is provided. The third side gusset 106 has an upper edge 110 and a lower edge 114 and extends inwardly from the first side edge 22 of the front wall 14 for a second predetermined distance 118 and outwardly for a third predetermined distance 122 to join the first side gusset 38. A fourth side gusset 126 is provided. The fourth side gusset 126 has an upper edge 110 and a lower edge 114 and extends inwardly from the first side edge 22 of the rear wall 18 for the second predetermined distance 118 and outwardly for the third predetermined distance 122 to join the first side gusset 38. A fifth side gusset 130 is provided. The fifth side gusset 130 has an upper edge 110 and a lower edge 114 and extends inwardly from the second side edge 26 of the front wall 14 for the second predetermined distance 118 and outwardly for the third predetermined distance 122 to join the second side gusset 42. A sixth side gusset 134 is provided. The sixth side gusset 134 has an upper edge 110 and a lower edge 114 and extends inwardly from the second side edge 26 of the rear wall 18 for the second predetermined distance 118 and outwardly for the third predetermined distance 122 to join the second side gusset 42. The upper seam 58 seals the top edge 30 of the front wall 14, upper edges 110 of the first 38, second 42, third 106, fourth 126, fifth 130 and sixth 134 side gussets and the top edge 30 of the rear wall 18 together. The first lower seam 62 seals the bottom edge 34 of the front wall 14, lower edges 114 of the first 38, second 42, third 106, fourth 126, fifth 130 and sixth 134 side gussets and the bottom edge 34 of the rear wall 18 together.

Figure 11:
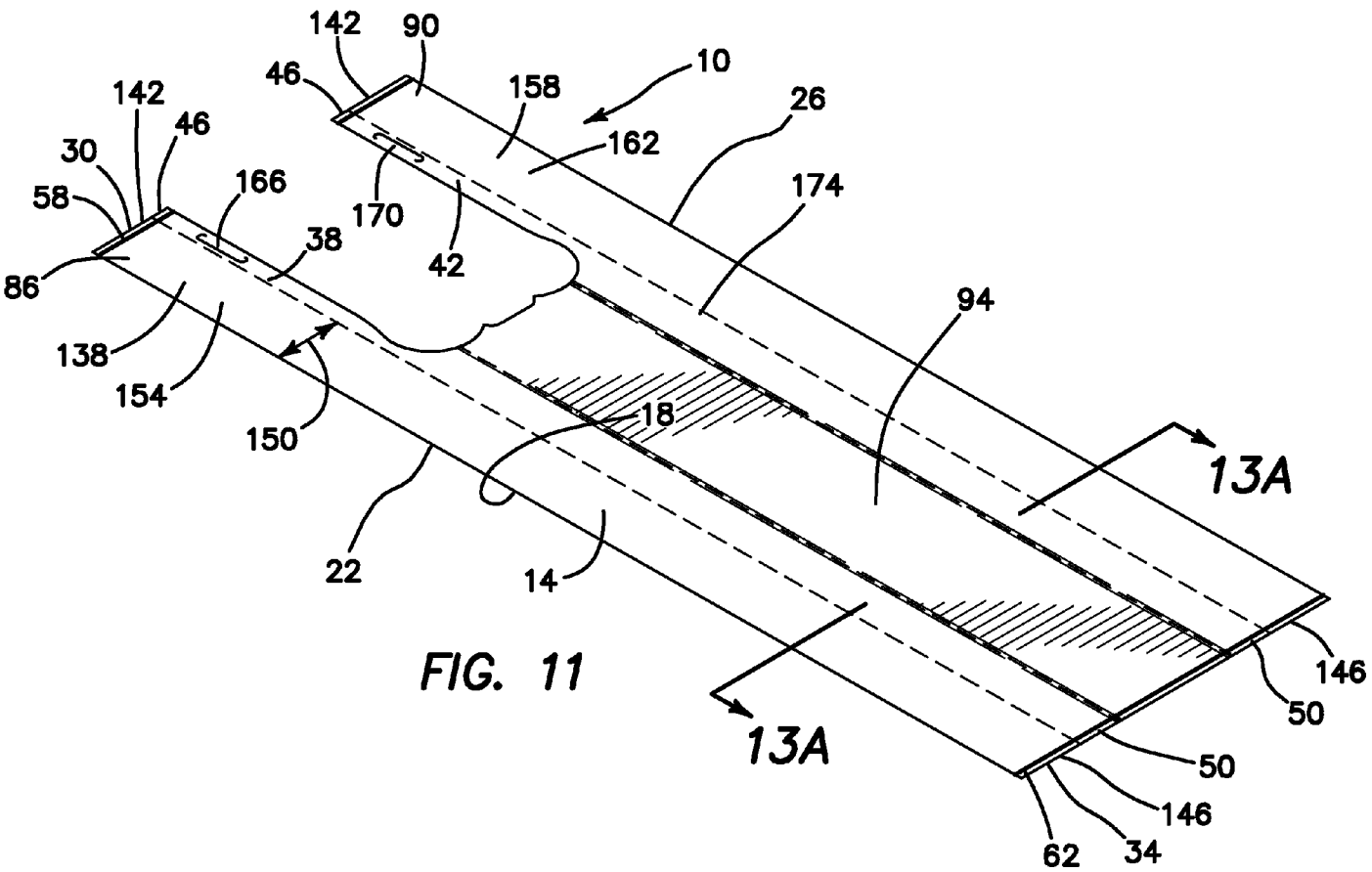
FIG. 11 is a perspective view of a sixth embodiment of the invention illustrating an improved gusseted T-shirt style bag having an area of increased wall thickness.

(44) In another variant, as illustrated in FIGS. 11 and 13A, a first folded portion 138 is provided. The first folded portion 138 has an upper edge 142 and a lower edge 146 and is folded into the first side gusset 38 from the first side edge 22 of the front wall 14 for a second predetermined distance 150. A second folded portion 154 is provided. The second folded portion 154 has an upper edge 142 and a lower edge 146 and is folded into the first side gusset 38 from the first side edge 22 of the rear wall 18 for the second predetermined distance 150. A third folded portion 158 is provided. The third folded portion 158 has an upper edge 142 and a lower edge 146 and is folded into the second side gusset 42 from the second side edge 26 of the front wall 14 for the second predetermined distance 150. A fourth folded portion 162 is provided. The fourth folded portion 162 has an upper edge 142 and a lower edge 146 and is folded into the second side gusset 42 from the second side edge 26 of the rear wall 18 for the second predetermined distance 150. The upper seam 58 seals the top edge 30 of the front wall 14, upper edges 46 of the first 38 and second 42 side gussets, upper edges 142 of the first 138, second 154, third 158 and fourth 162 folded portions and the top edge 30 of the rear wall 18 together. The first lower seam 62 seals the bottom edge 34 of the front wall 14, lower edges 50 of the first 38 and second 42 side gussets, lower edges 146 of the first 138, second 154, third 158 and fourth 162 folded portions and the bottom edge 34 of the rear wall 18 together.

(45) In still another variant, as illustrated in FIGS. 11, 12 and 14, first 166 and second 170 openings are provided. The first 166 and second 170 openings penetrate and extend transversely through each of the bag handles 86, 90. The openings 166, 170 are spaced downwardly from the top edge 30, spaced inwardly from the first 22 and second 26 side edges and serve to support the bag 10 on horizontal arms (not shown) of a dispensing rack (not shown).

(46) In yet another variant, at least a portion 174 of at least one of the front 14 and rear 18 bag walls is corona treated.

Figure 16:
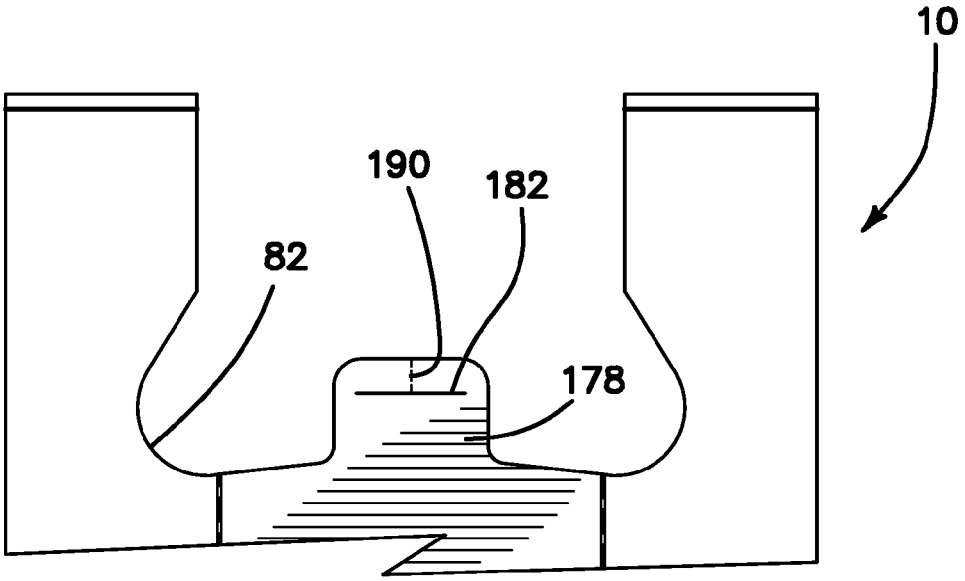
FIG. 16 is a partial front view of the FIG. 14 embodiment illustrating a tabless center tab bag with frangible aperture and stress relief bag mouth design.
Figure 17:
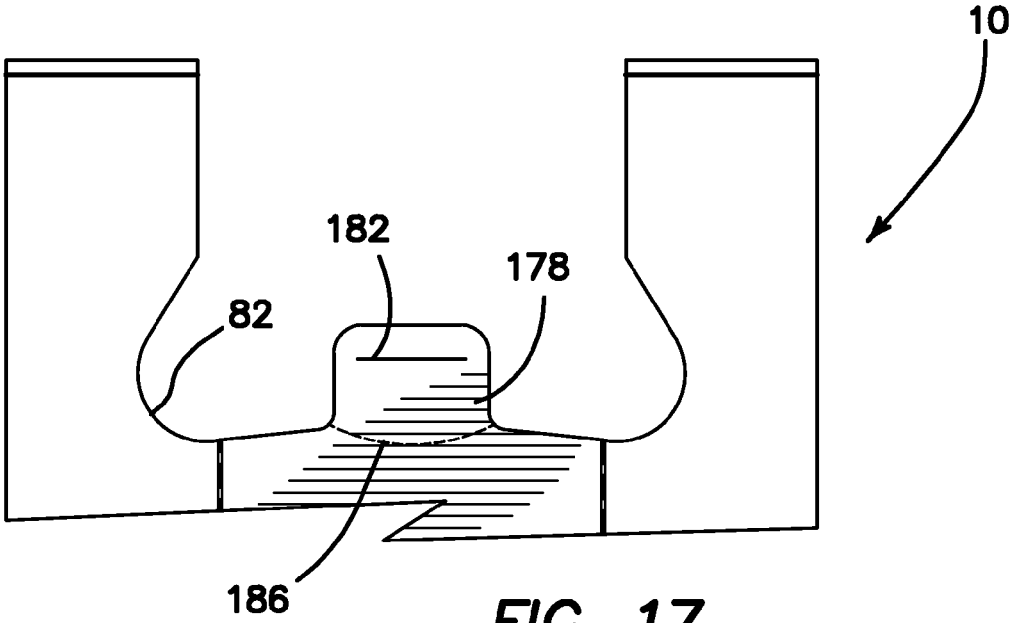
FIG. 17 is a partial front view of the FIG. 14 embodiment illustrating a tabbed center tab bag with frangible attachment to the bag mouth and stress relief bag mouth design.

(47) In a further variant, as illustrated in FIGS. 16 and 17, a central tab portion 178 connected to the open mouth portion 82 of the bag 10 is provided. An aperture 182 is provided. The aperture 182 extends transversely through the bag 10 within the central tab portion 178 for suspending the bag 10 from a dispensing rack.

(48) In still a further variant, as illustrated in FIG. 17, the central tab portion 178 is attached to the open mouth portion 82 with a frangible section 186. The frangible section 186 breaks when the bag 10 is pulled from the dispensing rack.

(49) In another variant of the invention, as illustrated in FIG. 16, the aperture 182 in the central tab portion 178 includes a frangible portion 190. The frangible portion 190 breaks when the bag 10 is pulled from the dispensing rack.

(50) In still another variant, as illustrated in FIG. 14, the open mouth portion 82 includes stress relief areas 194. The stress relief areas 194 have curved inner corners 198 wherein a cut line 202 forming the corners 198 extends from a vertical inner edge 206 of the bag handle 86, 90 outwardly toward one of the first 22 and second 26 side edges, downwardly toward the lower seam 62 and upwardly at a shallow angle toward a center line 210 of the front 14 and rear 18 bag walls, thereby reducing the likelihood that the open mouth portion 82 may tear under tension.

(51) In a further variant, a second lower seam 214 is provided. The second lower seam 214 is spaced upwardly from said first lower seam 62 by a second predetermined distance 218.

(52) In yet a further variant, the area of increased thickness 94 ranges from 125% to 130% of the thickness of a balance of film material 95 in the bag 10.

(53) In another variant of the invention, the balance of film material 95 in the improved bag 10 is 80% to 85% of the thickness of thermoplastic material of the typical T-Shirt style bag 11.

(54) In still another variant, the bag 10 includes 90% to 92% of the film material of the typical T-Shirt style bag 11.

(55) In yet another variant the area of increased thickness 94 is 8% to 15% thicker than the film material of the typical T-Shirt style bag 11.

Conventional gusseted bags as illustrated in FIGS. 9A, 10A, 14A and 15A have two point of inherent weakness 116, 120 on the lower seam 36, 62 at the points where the gusseted portions 100, 104 and 38, 42 meet the ungusseted portions of the bag walls 12, 16 and 14, 18. The reason for this is that conventional gusseted bags 9 and 11 are made of film of uniform thickness. In a bag 9 and 11 having a single gusset 100, 104 and 38, 42 at each side, when the bags 9 and 11 are being formed and the gussets 100, 104 and 38, 42 are folded in place, there will be four layers of plastic in the gusseted portions 100, 104 and 38, 42 of the bag 9 and 11 while there will be only two layers in the center, ungusseted portion of the bag 9 and 11. When the lower edge 32 and 50 of the bag is heat sealed, there will be twice as much plastic to heat seal together at the gusseted portions 100, 104 and 38, 42 as at the ungusseted portion. This leads to compromises as to the temperature and pressure to apply to the lower seam of the bag 9 and 11 so as to join all four layers in the gusseted portions 100, 104 and 38, 42 while not overheating and damaging the ungusseted portion.

In the present invention, as illustrated in FIGS. 9, 10, 14 and 15 in which the gusseted portions 100, 104 and 38, 42 of the bag 10 and 13 can be approximately half of the film thickness as the ungusseted portions, a single side gusset bag 10 and 13 will have substantially the same thickness for the four layers in the gusseted portions 100, 104 and 38, 42 of the bag 10 and 13 as for the two layers in the ungusseted portion. As a result, heat and pressure used in forming the lower seam of the bag 10 and 13 can be optimized for the strongest possible bag bottom. The present invention also provides for bag designs that include folded-in gussets and multiple gussets, as illustrated in FIGS. 12, 13A and 13B. The reduction in thickness of the plastic film used in the gusseted portions of the bags 10 is particularly important for these designs as they would otherwise have much more significant differences in thickness of the plastic layers to be sealed together to form a bag bottom.

(56) In a further variant, as illustrated in FIGS. 12 and 13B, the improved T-Shirt style bag 10 further includes at least one pair of additional first side edge gussets 106, 126. Each of the first side edge gussets 106, 126 has an upper edge 110 and a lower edge 114 and extends inwardly from the first side edge 22 of either the front wall 14, the rear wall 18 or one of the additional first side edge gussets 106, 126 for a second predetermined distance 118 and outwardly for a third predetermined distance 122 to join either the first side gusset 38 or one of the additional first side edge gussets 106, 126. The improved T-Shirt style bag 10 also further includes at least one pair of additional second side edge gussets 130, 134. Each of the second side edge gussets 130, 134 has an upper edge 110 and a lower edge 114 and extends inwardly from the second side edge 26 of either the front wall 14, the rear wall 18 or one of the additional second side edge gussets 130, 134 for the second predetermined distance 118 and outwardly for the third predetermined distance 122 to join either the second side gusset 42 or one of the additional second side edge gussets 130, 134.

The upper seam 58 seals the top edge 30 of the front wall 14, the upper edges 110 of the first 38 and second 42 gussets, at least one pair of additional first side edge gussets 106, 126, at least one pair of additional second side edge gussets 130, 134 and the top edge 30 of the rear wall 18 together. The lower seam 62 seals the bottom edge 34 of the front wall 14, the lower edges 114 of the first 38 and second 42 gussets, at least one pair of additional first side edge gussets 106, 126, at least one pair of additional second side edge gussets 130, 134 and the bottom edge 34 of the rear wall 18 together.

(5) In a final variant, as illustrated in FIGS. 11 and 13A, the improved T-Shirt style bag 10 further includes at least one pair of first side folded portions 138, 154. The first side folded portions 138, 154 have an upper edge 142 and a lower edge 146 and are folded into either the first side gusset 38 or one of the first side folded portions 138, 154 from the first side edge 22 of either the front wall 14, the rear wall 18 or one of the first side folded portions 138, 154 for a second predetermined distance 150. The improved T-Shirt style bag 10 also further includes at least one pair of second side folded portions 158, 162. The second side folded portions 158, 162 have an upper edge 142 and a lower edge 146 and are folded into either the second side gusset 42 or one of the second side folded portions 158, 162 from the second side edge 26 of either the front wall 14, the rear wall 18 or one of the second side folded portions 158, 162 for the second predetermined distance 150.

The upper seam 58 seals the top edge 30 of the front wall 14, the upper edges 46 of the first 38 and second 42 side gussets, the upper edges 142 of the at least one pair of first side folded portions 138, 154 and the at least one pair of second side folded portions 158, 162 and the top edge 30 of the rear wall 18 together. The lower seam 62 seals the bottom edge 34 of the front wall 14, the lower edges 50 of the first 38 and second 42 side gussets, the lower edges 146 of the at least one pair of first side folded portions 138, 154 and the at least one pair of second side folded portions 158, 162 and the bottom edge 34 of the rear wall 158, 162 together.

In order to demonstrate the utility of the present invention, a series of laboratory tests were conducted on thermoplastic bag film of differing thicknesses. When used in the manufacture of merchandise bags, plastic film needs to be resistant to both sudden puncturing and to tearing under load. In order to test the film for puncture resistance, a Dart Test, known as ASTM D1709, is employed. These test methods cover the determination of the energy that causes film to fail under specified conditions of impact of a free-falling dart. This energy is expressed in terms of the weight (mass) of the missile falling from a specified height which would result in 50% failure of specimens tested. Test Method A was employed for the results shown below. Test Method A employs a dart with a 38.10±0.13-mm (1.500±0.005-in.) diameter hemispherical head dropped from a height of 0.66±0.01 m (26.0±0.4 in.). This test method may be used for films whose impact resistances require masses of about 50 g or less to about 2 kg to fracture them.

Figure 18:
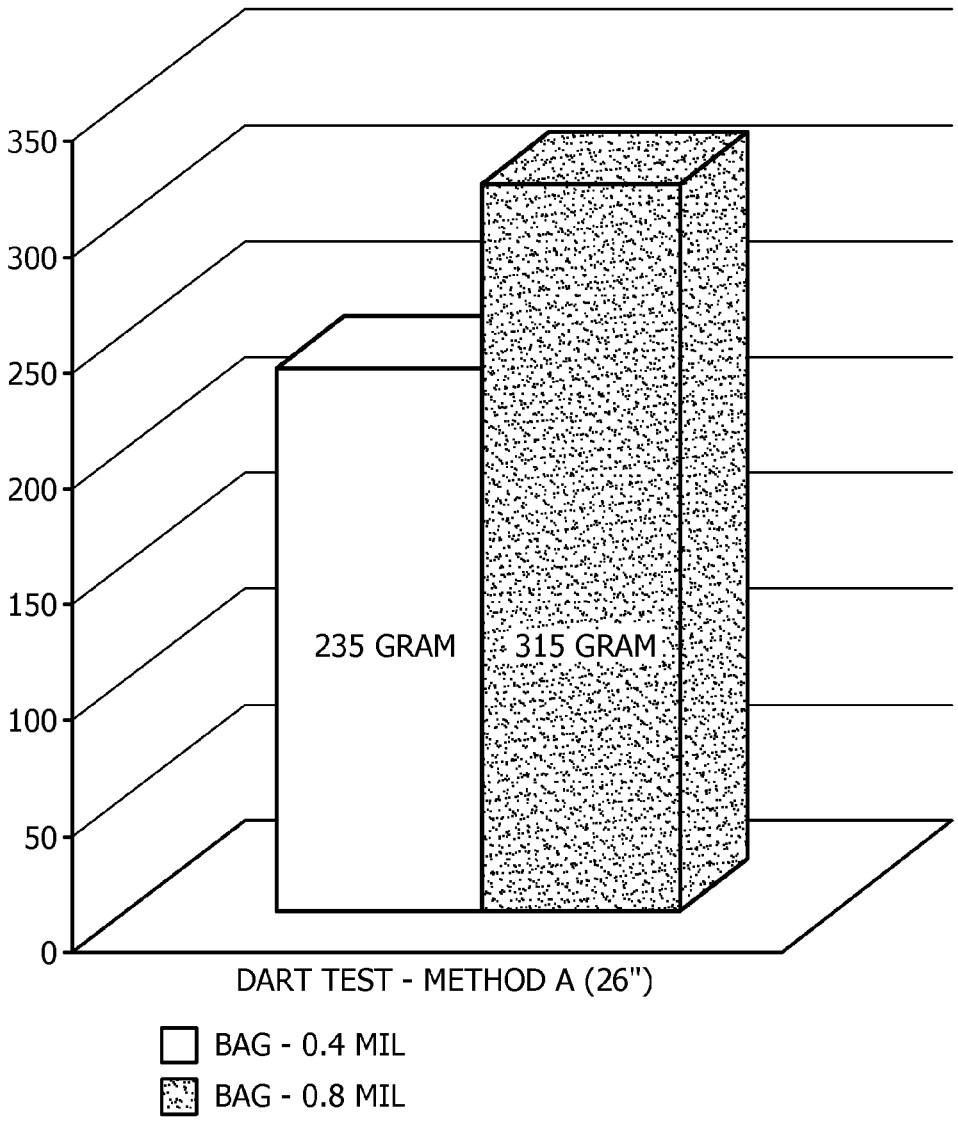
FIG. 18 is a table illustrating the Free-Falling Dart method test results.

The Method A test was performed on 0.4 mil and 0.8 mil plastic bags with the result that the 0.4 mil bag required a 235 gram dart to rupture the bag film while the 0.8 mil bag required a 315 gram to cause rupture. Thus the 0.8 mil bag required approximately 134% more weight to rupture than did the 0.4 mil bag film. This result is shown below in FIG. 18. This test procedure is particularly useful in gauging a bag's resistance to puncturing due to objects being dropped into the bag while the bag is suspended, as from a dispensing rack. As a puncturing force of this type is typically seen as a downward force against a bag's bottom or the joining of its side walls, making the bag walls out of a heavier plastic film can result in a bag having strength greater than or equal to a bag made of a uniform thickness plastic film that is thinner than the heavier plastic walls of the present invention. A bag made according to the design of the present invention will be strong in the critical areas where such strength is needed and thinner in those areas where such strength is either not needed or found in other features of the invention, such as multi-layered handles.

In order to test the film for tear resistance, the Standard Test Method for Propagation Tear Resistance of Plastic Film and Thin Sheet by Pendulum Method, as described in ASTM D 1922, was employed. This test method covers the determination of the average force to propagate tearing through a specified length of plastic film or nonrigid sheeting after the tear has been started, using an Elmendorf-type tearing tester. This tester involves a relatively dull knife attached to a weighted pendulum arm that impinges upon the sheet or film surface. In the present case weights of 400 grams and 800 grams were attached to the pendulum. The Tear Resistance test was performed on 0.4 mil and 0.8 mil plastic bags using the MD (in line) and TD (transverse) orientations of the test film. For the MD orientation, the 0.4 mil film required an average of 4.5 grams of force to tear the film while the 0.8 mil film required and average of 11.4 grams of force to tear.

Figure 19:
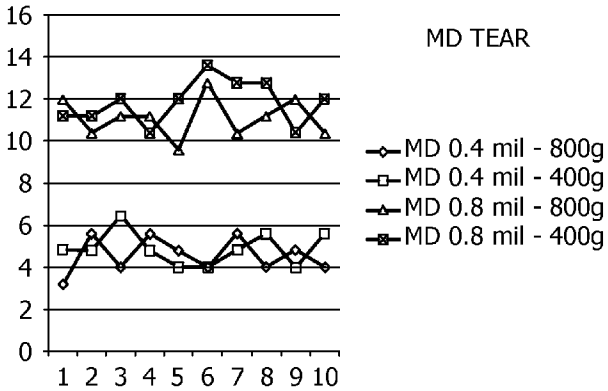
FIG. 19 is a table illustrating Propagation Tear Resistance of Plastic Film and Thin Sheet by Pendulum Method.
Figure 19:
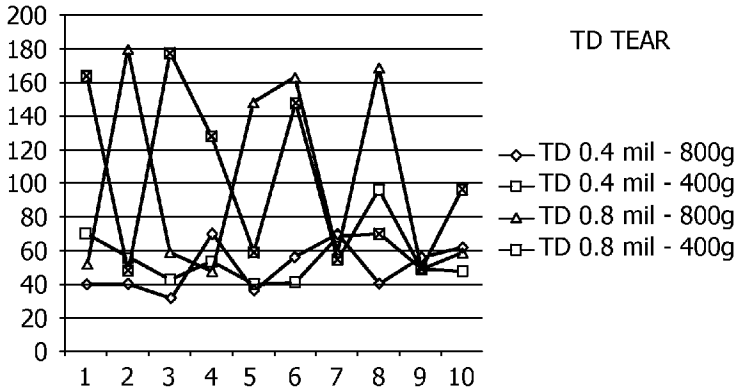

For the TD orientation, the 0.4 mil film required an average of 52 grams of force to tear the film while the 0.8 mil film required and average of 99 grams of force to tear. Thus for either orientation, the 0.8 mil film required approximately twice the force to tear as did the 0.4 mil film. Note that the standard deviation for the force required to tear the film in the TD (transverse) direction is, on average 13-54 times greater that in the MD (inline) direction. This is usually a result of the uniformity of bonds in the plastic film in the inline direction being substantially greater than that in the transverse direction. This result is shown below in FIG. 19. Here, using the heavier, 0.8 mil film in those areas of the bag most subject to tearing force, namely the front and rear bag walls will provide sufficient strength while allowing use of a lighter film for less sensitive areas, such as the bag handles. The present invention calls for multiple bag handles which thus can be made of a thinner film. In addition, the bag handles are typically not subject to puncture or tearing forces, but only tensile forces. The use of multiple layers for the bag handles has been found to provide adequate tensile strength even when the handles are formed of thinner than normal plastic film.

Conventional gusseted bags have two point of inherent weakness on the lower seam at the points where the gusseted portion meets the ungusseted portions of the bag walls. The reason for this is that conventional gusseted bags are made of film of uniform thickness. In a bag having a single gusset at each side, when the bags are being formed and the gussets are folded in place, there will be four layers of plastic in the gusseted portions of the bag while there will be only two layers in the center, ungusseted portion of the bag. When the lower edge of the bag is heat sealed, there will be twice as much material to heat seal together at the gusseted portions as at the ungusseted portion. This leads to compromises as to the temperature and pressure to apply to the lower seam of the bag so as to join all four layers in the gusseted portions while not overheating and damaging the ungusseted portion.

In the present invention, in which the gusseted portions of the bag can be approximately half of the film thickness as the ungusseted portions, a single side gusset bag will have substantially the same thickness for the four layers in the gusseted portions of the bag as for the two layers in the ungusseted portion. As a result, heat and pressure used in forming the lower seam of the bag can be optimized for the strongest possible bag bottom. The present invention also provides for bag designs that include folded in gussets and multiple gussets. The reduction in thickness of the film used in the gusseted portions of the bags is particularly important for these designs as they would otherwise have much more significant differences in thickness of the layers to be sealed together to form a bag bottom.

The improved merchandise 8, gusseted merchandise 13 and improved T-Shirt style 10 bags have been described with reference to particular embodiments. Other modifications and enhancements can be made without departing from the spirit and scope of the invention. For example, bags have been shown with one and three side gussets and well as bags with front walls folded into the side gusset. Bags could also be constructed with additional side gussets for increased handle strength.

The invention claimed is:

1. An improved merchandise bag, a typical merchandise bag comprising:

front and rear walls of film material of uniform thickness, each of said front and rear walls having first and second side edges, a top edge and a bottom edge;

said front and rear walls being joined at said first and second side edges;

a first lower seam, said first lower seam sealing said bottom edge of said front wall, and said bottom edge of said rear wall together; and said improvement comprising:

at least one of said front and rear walls having an area of increased thickness, said area of increased thickness extending from said top edge to said bottom edge and from a first point spaced inwardly from said first side edge by at least a first predetermined distance to a second point spaced inwardly from said second side edge by at least said first predetermined distance; and said film material comprising about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

2. The improved merchandise bag, as described in claim 1, further comprising 0.5 wt. % slip and antiblock compound.

3. The improved merchandise bag, as described in claim 1, further comprising 1-3 wt. % calcium carbonate.

4. The improved merchandise bag, as described in claim 1, further comprising 10-20 wt. % recycled material, said recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

5. The improved merchandise bag, as described in claim 1, wherein 10-15 wt. % of said linear low density polyethylene has a density ranging from 0.923-0.924 gm/cc.

6. The improved merchandise bag, as described in claim 1, wherein 10-15 wt. % of said linear low density polyethylene has a melt index ranging from 0.25-0.30 gm/10 minutes.

7. The improved merchandise bag, as described in claim 1, wherein said high density, medium molecular weight polyethylene has a density ranging from 0.937-0.947 gm/cc.

8. An improved merchandise bag, a typical merchandise bag comprising:

front and rear walls of film material of uniform thickness, each of said front and rear walls having first and second side edges, a top edge and a bottom edge;

said front and rear walls being joined at said first and second side edges;

a first lower seam, said first lower seam sealing said bottom edge of said front wall, and said bottom edge of said rear wall together; and said improvement comprising:

at least one of said front and rear walls having an area of increased thickness, said area of increased thickness extending from said top edge to said bottom edge and from a first point spaced inwardly from said first side edge by at least a first predetermined distance to a second point spaced inwardly from said second side edge by at least said first predetermined distance; and said film material comprising at least one of polylactic acid (PLA), poly-3-hydroxybutyrate (PHB) and genetically modified bioplastics.

9. The improved merchandise bag, as described in claim 1 or claim 8, a second lower seam, said second lower seam spaced upwardly from said first lower seam by a second predetermined distance.

10. The improved merchandise bag, as described in claim 1 or claim 8, further comprising a centrally disposed handle.

11. The improved merchandise bag, as described in claim 9, wherein said handle is selected from the group consisting of: soft loop, round die cut, oval die cut, wave top, patch and rigid.

12. The improved merchandise bag, as described in claim 1 or claim 8, wherein said bag is formed of either of mono layer and multi-layer film material.

13. The improved merchandise bag, as described in claim 1 or claim 8, wherein at least a portion of at least one of said front and rear bag walls is corona treated.

14. The improved merchandise bag, as described in claim 1 or claim 8, wherein said area of increased thickness ranges from 125% to 130% of thickness of a balance of film material in said bag.

15. The improved merchandise bag, as described in claim 14, wherein said balance of thermoplastic material in said bag is 80% to 85% of thickness of film material of said typical merchandise bag.

16. The improved merchandise bag, as described in claim 1 or claim 8, wherein said bag comprises 90% to 92% of film material of said typical merchandise bag.

17. The improved merchandise bag, as described in claim 1 or claim 8, wherein said area of increased thickness is 8% to 15% thicker than film material of said typical merchandise bag.

18. An improved merchandise bag, a typical merchandise bag comprising:

front and rear walls of film material of uniform thickness, each of said front and rear walls having first and second side edges, a top edge and a bottom edge;

first and second side gussets, said side gussets having upper and lower edges and extending inwardly from said first and second side edges of said front and rear walls for a first predetermined distance;

a first lower seam, said first lower seam sealing said bottom edge of said front wall, lower edges of said first and second side gussets and said bottom edge of said rear wall together; and said improvement comprising:

at least one of said front and rear walls having an area of increased thickness, said area of increased thickness extending from said top edge to said bottom edge and from a first point spaced inwardly from said first side edge by at least said first predetermined distance to a second point spaced inwardly from said second side edge by at least said first predetermined distance; and said film material comprising about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

19. The improved merchandise bag, as described in claim 18, further comprising 0.5 wt. % slip and antiblock compound.

20. The improved merchandise bag, as described in claim 18, further comprising 1-3 wt. % calcium carbonate.

21. The improved merchandise bag, as described in claim 18, further comprising 10-20 wt. % recycled material, said recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

22. The improved merchandise bag, as described in claim 18, wherein 10-15 wt. % of said linear low density polyethylene has a density ranging from 0.923-0.924 gm/cc.

23. The improved merchandise bag, as described in claim 18, wherein 10-15 wt. % of said linear low density polyethylene has a melt index ranging from 0.25-0.30 gm/10 minutes.

24. The improved merchandise bag, as described in claim 18, wherein said high density, medium molecular weight polyethylene has a density ranging from 0.937-0.947 gm/cc.

25. An improved merchandise bag, a typical merchandise bag comprising:

front and rear walls of film material of uniform thickness, each of said front and rear walls having first and second side edges, a top edge and a bottom edge;

first and second side gussets, said side gussets having upper and lower edges and extending inwardly from said first and second side edges of said front and rear walls for a first predetermined distance;

a first lower seam, said first lower seam sealing said bottom edge of said front wall, lower edges of said first and second side gussets and said bottom edge of said rear wall together; and said improvement comprising:

at least one of said front and rear walls having an area of increased thickness, said area of increased thickness extending from said top edge to said bottom edge and from a first point spaced inwardly from said first side edge by at least said first predetermined distance to a second point spaced inwardly from said second side edge by at least said first predetermined distance; and said film material comprising at least one of polylactic acid (PLA), poly-3-hydroxybutyrate (PHB) and genetically modified bioplastics.

26. The improved merchandise bag, as described in claims 18 or 25, further comprising a second lower seam, said second lower seam spaced upwardly from said first lower seam by a second predetermined distance.

27. The improved merchandise bag, as described in claims 18 or claim 25, further comprising a centrally disposed handle.

28. The improved merchandise bag, as described in claim 27, wherein said handle is selected from the group consisting of: soft loop, round die cut, oval die cut, wave top, patch and rigid.

29. The improved merchandise, as described in claims 18 or claim 25, wherein said improved bag is formed of either of mono layer and multi-layer film material.

30. The improved merchandise bag, as described in claims 18 or claim 25, wherein at least a portion of at least one of said front and rear bag walls is corona treated.

31. The improved merchandise bag, as described in claims 18 or claim 25, wherein said area of increased thickness ranges from 125% to 130% of thickness of a balance of film material in said bag.

32. The improved merchandise bag, as described in claim 31, wherein said balance of film material in said bag is 80% to 85% of thickness of thermoplastic material of said typical gusseted merchandise bag.

33. The improved merchandise bag, as described in claims 18 or claim 25, wherein said improved bag comprises 90% to 92% of film material of said typical gusseted merchandise bag of similar size.

34. The improved merchandise bag, as described in claims 18 or claim 25, wherein said area of increased thickness is 8% to 15% thicker than film material of said typical gusseted merchandise bag.

35. An improved T-Shirt style bag, a typical T-Shirt style bag comprising:

front and rear walls of film material of uniform thickness, each of said front and rear walls having first and second side edges, a top edge and a bottom edge;

first and second side gussets, said side gussets having upper and lower edges and extending inwardly from said first and second side edges of said front and rear walls for a first predetermined distance;

an upper seam, said upper seam sealing said top edge of said front wall, upper edges of said first and second side gussets and said top edge of said rear wall together;

a first lower seam, said first lower seam sealing said bottom edge of said front wall, lower edges of said first and second side gussets and said bottom edge of said rear wall together;

a U-shaped cut-out, said U-shaped cut-out being disposed in an upper portion of said bag and commencing at a first point along said top edge spaced inwardly from said first side edge and extending to a second point along said top edge spaced inwardly from said second side edge, said cut-out extending downwardly toward said bottom edges, thereby forming an open mouth portion and a pair of bag handles; and said improvement comprising:

at least one of said front and rear walls having an area of increased thickness, said area of increased thickness extending from said open mouth portion to said bottom edge and from a first point spaced inwardly from said first side edge by at least said first predetermined distance to a second point spaced inwardly from said second side edge by at least said first predetermined distance; and said film material comprising about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes and 0-8 wt. % color concentrate.

36. The improved T-Shirt style bag, as described in claim 35, further comprising 0.5 wt. % slip and antiblock compound.

37. The improved T-Shirt style bag, as described in claim 35, further comprising 1-3 wt. % calcium carbonate.

38. The improved T-Shirt style bag, as described in claim 35, further comprising 10-20 wt. % recycled material, said recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

39. The improved T-Shirt style bag, as described in claim 35, wherein 10-15 wt. % of said linear low density polyethylene has a density ranging from 0.923-0.924 gm/cc.

40. The improved T-Shirt style bag, as described in claim 35, wherein 10-15 wt. % of said linear low density polyethylene has a melt index ranging from 0.25-0.30 gm/10 minutes.

41. The improved T-Shirt style bag, as described in claim 35, wherein said high density, medium molecular weight polyethylene has a density ranging from 0.937-0.947 gm/cc.

42. An improved T-Shirt style bag, a typical T-Shirt style bag comprising:

front and rear walls of film material of uniform thickness, each of said front and rear walls having first and second side edges, a top edge and a bottom edge;

first and second side gussets, said side gussets having upper and lower edges and extending inwardly from said first and second side edges of said front and rear walls for a first predetermined distance;

an upper seam, said upper seam sealing said top edge of said front wall, upper edges of said first and second side gussets and said top edge of said rear wall together;

a first lower seam, said first lower seam sealing said bottom edge of said front wall, lower edges of said first and second side gussets and said bottom edge of said rear wall together;

a U-shaped cut-out, said U-shaped cut-out being disposed in an upper portion of said bag and commencing at a first point along said top edge spaced inwardly from said first side edge and extending to a second point along said top edge spaced inwardly from said second side edge, said cut-out extending downwardly toward said bottom edges, thereby forming an open mouth portion and a pair of bag handles; and said improvement comprising:

at least one of said front and rear walls having an area of increased thickness, said area of increased thickness extending from said open mouth portion to said bottom edge and from a first point spaced inwardly from said first side edge by at least said first predetermined distance to a second point spaced inwardly from said second side edge by at least said first predetermined distance; and said film material comprising at least one of polylactic acid (PLA), poly-3-hydroxybutyrate (PHB) and genetically modified bioplastics.

43. The improved T-Shirt style bag, as described in claims 35 or claim 42, further comprising:

a third side gusset, said third side gusset having an upper edge and a lower edge and extending inwardly from said first side edge of said front wall for a second predetermined distance and outwardly for a third predetermined distance to join said first side gusset;

a fourth side gusset, said fourth side gusset having an upper edge and a lower edge and extending inwardly from said first side edge of said rear wall for said second predetermined distance and outwardly for said third predetermined distance to join said first side gusset;

a fifth side gusset, said fifth side gusset having an upper edge and a lower edge and extending inwardly from said second side edge of said front wall for said second predetermined distance and outwardly for said third predetermined distance to join said second side gusset;

a sixth side gusset, said sixth side gusset having an upper edge and a lower edge and extending inwardly from said second side edge of said rear wall for said second predetermined distance and outwardly for said third predetermined distance to join said second side gusset;

wherein said upper seam seals said top edge of said front wall, said upper edges of said first, second, third, fourth, fifth and sixth side gussets and said top edge of said rear wall together; and wherein said lower seam seals said bottom edge of said front wall, said lower edges of said first, second, third, fourth, fifth and sixth side gussets and said bottom edge of said rear wall together.

44. The improved T-Shirt style bag, as described in claim 35 or claim 42, further comprising:

a first folded portion, said first folded portion having an upper edge and a lower edge and being folded into said first side gusset from said first side edge of said front wall for a second predetermined distance;

a second folded portion, said second folded portion having an upper edge and a lower edge and being folded into said first side gusset from said first side edge of said rear wall for said second predetermined distance;

a third folded portion, said third folded portion having an upper edge and a lower edge and being folded into said second side gusset from said second side edge of said front wall for said second predetermined distance;

a fourth folded portion, said fourth folded portion having an upper edge and a lower edge and being folded into said second side gusset from said second side edge of said rear wall for said second predetermined distance;

wherein said upper seam seals said top edge of said front wall, said upper edges of said first and second side gussets, said upper edges of said first, second, third and fourth folded portions and said top edge of said rear wall together; and wherein said lower seam seals said bottom edge of said front wall, said lower edges of said first and second side gussets, said lower edges of said first, second, third and fourth folded portions and said bottom edge of said rear wall together.

45. The improved T-Shirt style bag, as described in claims 35 or claim 42, further comprising:

first and second openings, said first and second openings penetrating and extending transversely through each of said bag handles; and said openings being spaced downwardly from said top edge, spaced inwardly from said first and second side edges and serving to support said bag on horizontal arms of a dispensing rack.

46. The improved T-Shirt style bag, as described in claims 35 or claim 42, wherein at least a portion of at least one of said front and rear bag walls is corona treated.

47. The improved T-Shirt style bag, as described in claim 35 or 42, further comprising:

a central tab portion connected to said open mouth portion of said bag; and an aperture, said aperture extending transversely through said bag within said central tab portion for suspending said bag from a dispensing rack.

48. The improved T-Shirt style bag, as described in claim 46, wherein said central tab is attached to said bag mouth portion with a frangible section, said frangible section breaking when said bag is pulled from said dispensing rack.

49. The improved T-Shirt style bag, as described in claim 46, wherein said aperture in said central tab further comprises a frangible portion, said frangible portion breaking when said bag is pulled from said dispensing rack.

50. The improved T-Shirt style bag, as described in claim 35 or 42, wherein said open mouth portion comprises stress relief areas, said stress relief areas having curved inner corners wherein a cut line forming said corners extends from a vertical inner edge of said bag handle outwardly toward one of said first and second side edges, downwardly toward said lower seam and upwardly at a shallow angle toward a center line of said front and rear bag walls, thereby reducing the likelihood that said open mouth portion may tear under tension.

51. The improved T-Shirt style bag, as described in claims 35 or claim 42, further comprising a second lower seam, said second lower seam spaced upwardly from said first lower seam by a second predetermined distance.

52. The improved T-Shirt style bag, as described in claims 35 or claim 42, wherein said area of increased thickness ranges from 125% to 130% of thickness of a balance of film material in said bag.

53. The improved T-Shirt style bag, as described in claim 35 or 42, wherein said balance of thermoplastic material in said bag is 80% to 85% of thickness of film material of said typical merchandise bag.

54. The improved T-Shirt style bag, as described in claim 35 or 42, wherein said bag comprises 90% to 92% of film material of said typical merchandise bag of similar size.

55. The improved T-Shirt style bag, as described in claim 35 or 42, wherein said area of increased thickness is 8% to 15% thicker than film material of said typical merchandise bag.

56. The improved T-Shirt style bag, as described in claim 35 or 42, further comprising:

at least one pair of additional first side edge gussets, each of said first side edge gussets having an upper edge and a lower edge and extending inwardly from said first side edge of either of said front wall, said rear wall and one of said additional first side edge gussets for a second predetermined distance and outwardly for a third predetermined distance to join either of said first side gusset and one of said additional first side edge gussets;

at least one pair of additional second side edge gussets, each of said second side edge gussets having an upper edge and a lower edge and extending inwardly from said second side edge of either of said front wall, said rear wall and one of said additional second side edge gussets for said second predetermined distance and outwardly for said third predetermined distance to join either of said second side gusset and one of said additional second side edge gussets;

wherein said upper seam seals said top edge of said front wall, said upper edges of said first and second gussets, at least one pair of additional first side edge gussets, at least one pair of additional second side edge gussets and said top edge of said rear wall together; and wherein said lower seam seals said bottom edge of said front wall, said lower edges of said first and second gussets, at least one pair of additional first side edge gussets, at least one pair of additional second side edge gussets and said bottom edge of said rear wall together.

57. The improved T-Shirt style bag, as described in claim 35 or 42, further comprising:

at least one pair of first side folded portions, said first side folded portions having an upper edge and a lower edge and being folded into either of said first side gusset and one of said first side folded portions from said first side edge of either of said front wall, said rear wall and one of said first side folded portions for a second predetermined distance;

at least one pair of second side folded portions, said second side folded portions having an upper edge and a lower edge and being folded into either of said second side gusset and one of said second side folded portions from said second side edge of either of said front wall, said rear wall and one of said second side folded portions for said second predetermined distance;

wherein said upper seam seals said top edge of said front wall, said upper edges of said first and second side gussets, said upper edges of said at least one pair of first side folded portions, said at least one pair of second side folded portions and said top edge of said rear wall together; and wherein said lower seam seals said bottom edge of said front wall, said lower edges of said first and second side gussets, said lower edges of said at least one pair of first side folded portions, said at least one pair of second side folded portions and said bottom edge of said rear wall together.

* * * * *